US007104231B2

(12) United States Patent
Tashiro

(10) Patent No.: US 7,104,231 B2
(45) Date of Patent: Sep. 12, 2006

(54) VALVE TRAIN OF INTERNAL COMBUSTION ENGINE

(75) Inventor: Masahiko Tashiro, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/115,250

(22) Filed: Apr. 27, 2005

(65) Prior Publication Data

US 2005/0241599 A1 Nov. 3, 2005

(30) Foreign Application Priority Data

Apr. 28, 2004 (JP) ..... P.2004-134533

(51) Int. Cl.
*F01L 1/34* (2006.01)

(52) U.S. Cl. ..... 123/90.16; 123/90.2; 123/90.15; 123/90.27; 123/90.31

(58) Field of Classification Search ..... 123/90.16, 123/90.2
See application file for complete search history.

(56) References Cited

U.S. PATENT DOCUMENTS 6,467,443 B1 * 10/2002 Tsuruta et al. ..... 123/90.16
6,615,781 B1 * 9/2003 Tanaka et al. ..... 123/90.27

FOREIGN PATENT DOCUMENTS

JP 07-063023 3/1995

* cited by examiner

*Primary Examiner*—Thomas Denion
*Assistant Examiner*—Kyle M. Riddle
(74) *Attorney, Agent, or Firm*—Arent Fox, PLLC.

(57) ABSTRACT

The valve train V of an internal combustion engine E includes; a rocker arm 50, 60 for opening and closing the suction valve 13; a holding body 70 for holding the spring 77 to generate the bias force F3 for biasing the rocker arm 50 to the suction cam 21; and a drive shaft 81 for moving the supporting shaft 32, 33 of the rocker arm 50, 60 via the holder 30. The rocker arm 50 includes: an acting section 54 on which the bias force F3 of the spring 77 directly acts; a cam contact section 52 coming into contact with the suction cam 21. The holding body 70 provided integrally with the holder 30 moves following a position of the supporting shaft 32 which moves together with the holder 30. The spring 77 is arranged between the holding body 70 and the acting section 54, which are opposed to each other in the direction of the line of action of the bias force F3 and along the plane perpendicular to the rotary centerline L2 of the cam shaft 20.

13 Claims, 9 Drawing Sheets

VALVE TRAIN OF INTERNAL COMBUSTION ENGINE

The present invention claims foreign priority to Japanese patent application no. P.2004-134534, filed on Apr. 28, 2004, the contents of which is incorporated herein by reference.

BACKGROUND OF THE INVENTION

1. Technical Field

The present invention relates to a valve train of an internal combustion engine in which a valve operation characteristic can be changed which includes an opening and closing time and a maximum lift of an engine valve which is a suction valve or an exhaust valve.

2. Related Art

For example, Patent Document 1 discloses this type valve train. This valve train includes a transmission member having a supporting point moved by a rotatable eccentric body so that a reciprocating motion of a reciprocating valve provided in the cylinder head can be adjusted, and this transmission member is driven by a cam of the cam shaft so as to open and close the reciprocating valve. Further, in order to press the transmission member to the cam, a return lever or a return shaft, which will be referred to as a return lever and others hereinafter, acting in the transmission member is provided. The return lever and others are pushed by a compression spring supported by a guide element incorporated into the cylinder head.

[Patent Document 1]

JP-A-Hei7-63023

In this connection, in the valve train disclosed in Patent Document 1, the transmission member is driven and moved not only by the cam but also by the eccentric body. On the other hand, the guide element for supporting the compression spring is fixed to the cylinder head. Therefore, in the case where a movement of the supporting point of the transmission member is increased in order to increase the control range of the valve operation characteristic, that is, in the case where a movement of the supporting point of the transmission member is increased, for example, in order to increase at least one of the control range (change) of the maximum lift of the engine valve, which corresponds to the reciprocating process of the reciprocating valve of the valve train of Patent Document 1, and the control range (change) of the opening and closing time of the engine valve, the following problems may be encountered. Even when the transmission member is driven by the eccentric body and moved, the return lever and others are maintained in a state in which a bias force of the compression spring is given to the transmission member. In order to maintain this state, when a portion of the transmission member, which will be referred to as "an acting section" hereinafter, on which the return lever and others act, is increased in the size corresponding to the movement of the supporting point, the acting section of the transmission member is made larger in the size, that is, the valve train is made larger in the size. On the other hand, in order to avoid the increase in the size of the acting portion of the transmission portion, since it is necessary to give priority to an arrangement of the guide element, the size in the transmission member is increased and further the arrangement of the transmission member is restricted. As a result, the valve train is made larger in the size.

In the case where the movement of the supporting point of the transmission member is increased, an expansion and contraction of the compression spring are increased corresponding to the increase in the movement of the supporting point. Accordingly, a change in the bias force of the return lever and others given to the transmission member is increased. When the change in the bias force of the return lever and others is increased, it becomes difficult to press the transmission member to the cam by an appropriate bias force. Therefore, for example, the following problems are encountered. If the bias force is set at an appropriate value on the contraction side of the compression spring, when the compression spring is expanded, a sufficiently strong bias force can not be obtained. Since the bias force is excessively weak, vibration is generated in the transmission member. Therefore, it becomes difficult for the engine valve to be appropriately opened and closed. On the other hand, if the bias force is set at an appropriate value on the expansion side of the compression spring, when the compression spring is contracted, the bias force is excessively increased. Therefore, a contact portion, in which the return lever and the transmission member are contacted with each other, tends to be abraded. Accordingly, it becomes necessary to take measures for enhancing the anti-abrasion property of the contact portion, which raises the manufacturing cost. When a spring constant is set at a low value in order to suppress a change in the bias force caused by an increase in the expansion and contraction of the compression spring, the compression spring is made larger in the size.

SUMMARY OF THE INVENTION

The present invention is accomplished in view of the above circumstances. An object of the invention described in aspects 1 to 7 is to make a valve train small while a control range of a valve operation characteristic of an engine valve can be set large. An object of the invention described in aspect 2 is to extend a control range of a valve operation characteristic by a simple structure. An object of the invention described in aspect 3 is further to simplify a structure for making a holding body conduct a following motion and to suppress a change in the bias force. An object of the invention described in aspect 4 is to make a holder lighter and stronger. An object of the invention described in aspects 5 and 6 is to make a valve train smaller in the reference direction. An object of the invention described in aspect 6 is to enhance the accuracy of control of a valve operation characteristic.

The invention described in aspect 1 provides a valve train of an internal combustion engine provided in the internal combustion engine including a cylinder having a cylinder axis and a cylinder head connected to an upper end portion of the cylinder, the valve train of the internal combustion engine including:

a cam follower driven by a valve train cam provided on a cam shaft, for opening and closing an engine valve;

a holding body for holding a bias member to generate a bias force for biasing the cam follower to the valve train cam; and a drive mechanism for moving a supporting position of the cam follower, wherein a valve operation characteristic of the engine valve is changed when the supporting position is moved, the cam follower includes: an acting section on which the bias force directly acts; and a cam contact section coming into contact with the valve train cam by the bias force, and is supported at the supporting position, the holding body moves while following the supporting position that is moving, and the bias member is arranged between the holding body and the acting section, which are opposed to each other in a direction of a line of action of the bias force, along a plane perpendicular to a rotary centerline of the cam shaft.

Due to the foregoing, when the supporting position is moved being driven by the drive mechanism, the holding body and the bias member held by the holding body follow the supporting position. Therefore, compared with a case in which the holding body and the bias member are not moved, the acting section can be made smaller. Further, without increasing the size of the bias member, a change in the bias force for giving a force to the cam follower can be reduced. Further, since the bias member is arranged between the holding body and the acting section which are opposed to each other in the direction of the line of action of the bias force and also arranged along the plane perpendicular to the rotary centerline of the cam shaft, the bias member can be compactly arranged in the direction of the rotary centerline. Since the bias force is directly given to the acting section of the cam follower in which the cam contact section is provided, it becomes possible to give a bias force at an effective position so as to obtain an appropriate intensity of the bias force for the valve train. Therefore, the bias force can be reduced, and it is unnecessary to increase the rigidity of the cam follower.

The invention described in aspect 2 provides the valve train of an internal combustion engine according to aspect 1, wherein the cam follower opens and closes the engine valve via a valve drive member having a valve contact section which comes into contact with the engine valve, the valve train has a holder for supporting the cam follower at a first supporting position which is the supporting position, and for supporting the valve drive member at a second supporting position, and the drive mechanism drives the holder.

Due to the foregoing, when the first supporting position of the cam follower is moved in order to change the valve operation characteristic of the engine valve, the second supporting position for supporting the valve drive member is moved together. Therefore, it is possible to suppress a relative movement of the contact position of the cam follower with the valve drive member. Accordingly, compared with a case in which the valve drive member is not moved, it is possible to increase a movement of the first supporting position by a simple structure.

The invention described in aspect 3 provides the valve train of an internal combustion engine according to aspect 2, wherein the holding body is integrally provided in the holder, and a contact position of the acting section with the bias member is closer to the first supporting position than the contact position of the cam contact section with the valve train cam.

Due to the foregoing, the holding body can be made to follow the first position by the simple structure. Further, when the cam contact position is moved, a movement of the acting point of the bias force in the acting section is reduced. Therefore, a change in the bias force according to the movement of the first supporting position can be suppressed.

The invention described in aspect 4 provides the valve train of an internal combustion engine according to aspect 2 or 3, wherein the holder includes:

a pair of side walls for forming an accommodation space in which the cam follower is accommodated; and a supporting section provided on each side wall, for supporting the cam follower, and the holding body connects the pair of side walls at a position different from the position of the supporting body.

Due to the foregoing, since the holder having a pair of side walls can be connected by the holding body at a position except for the supporting section, the rigidity of the holder can be enhanced. Since the cam follower is supported by each side wall, it is possible for each side wall to prevent the cam follower from falling by the load such as a valve drive force given from the valve train. Further, the supporting rigidity of the cam follower can be enhanced by the holding body.

The invention described in aspect 5 provides the valve train of an internal combustion engine according to aspect 3 or 4, wherein the engine valve is a first engine valve including one of the suction valve and the exhaust valve, and the holding body is arranged at a position lower than the first supporting position on the side of the second engine valve including the other of the suction valve and the exhaust valve in the direction of the rotary centerline so that the holding body overlaps on the second engine valve when viewed in the direction of the rotary centerline.

Due to the foregoing, by utilizing a space formed on the side of the second engine valve in the direction of the rotary centerline, the holding body can be arranged.

The invention described in aspect 6 provides the valve train of an internal combustion engine according to aspect 1, wherein the drive mechanism extends in parallel with the rotary centerline and includes a drive shaft for moving the supporting position, the drive shaft is arranged at a position lower than the cam follower in a valve train chamber formed by the cylinder head, the cam shaft is arranged at a position higher than the supporting position, and the holding body is arranged between the cam shaft and the drive shaft in the vertical direction and moved between the cam shaft and the drive shaft in the vertical direction.

Due to the foregoing, a relatively large space can be formed in the vertical direction between the cam shaft and the drive shaft, and the holding body can be moved in the vertical direction by utilizing the space. Further, the supporting position can be moved by a large movement. Further, since the drive shaft is arranged in a portion on the lower side, the rigidity of which is high because the portion is located close to the connecting section with the cylinder in the cylinder head, the drive shaft can be supported by a high supporting rigidity.

The invention described in aspect 7 provides a valve train of an internal combustion engine provided in the internal combustion engine including a cylinder having a cylinder axis and a cylinder head connected to an upper end portion of the cylinder, the valve train of the internal combustion engine including:

a cam follower driven by a valve train cam provided on a cam shaft, for opening and closing an engine valve;

a holding body for holding a bias member to generate a bias force for biasing the cam follower to the valve train cam; and a drive mechanism for moving a supporting position of the cam follower, wherein a valve operation characteristic of the engine valve is changed when the supporting position is moved, the cam follower includes: an acting section on which the bias force directly acts; and a cam contact section coming into contact with the valve train cam by the bias force, and is supported at the supporting position, the holding body moves while following the supporting position that is moving, and at least one portion of the holding position of the bias member in the holding body is in a range of the arrangement of the valve train cam or the cam contact section in a direction of the rotary centerline of the cam shaft.

Due to the foregoing, at least a portion of the holding position of the bias member in the holding body is in a range in which the valve train cam or the cam contact portion is arranged in the direction of the rotary centerline. Therefore, since the bias member is compactly arranged in the direction of the rotary centerline, the same operational effect as that of aspect 1 can be provided.

Further, the similar effect is expected in the inventions as follows.

The invention described in aspect 8 provides the valve train of an internal combustion engine according to aspect 1, wherein the cam follower opens and closes the engine valve via a valve drive member having a valve contact section which comes into contact with the engine valve, the valve train has a holder for supporting the cam follower at a supporting position which is the supporting position.

The invention described in aspect 9 provides the valve train of an internal combustion engine according to aspect 8, wherein the holding body is integrally provided in the holder, and a contact position of the acting section with the bias member is closer to the supporting position than the contact position of the cam contact section with the valve train cam.

The invention described in aspect 10 provides the valve train of an internal combustion engine according to aspect 8, wherein the holder includes:

a pair of side walls for forming an accommodation space in which the cam follower is accommodated; and a supporting section provided on each side wall, for supporting the cam follower, and the holding body connects the pair of side walls at a position different from the position of the supporting body.

The invention described in aspect 11 provides the valve train of an internal combustion engine according to aspect 9, wherein the engine valve is a first engine valve including one of the suction valve and the exhaust valve, and the holding body is arranged at a position lower than the supporting position on the side of the second engine valve including the other of the suction valve and the exhaust valve in the direction of the rotary centerline so that the holding body overlaps on the second engine valve when viewed in the direction of the rotary centerline.

The invention described in aspect 12 provides the valve train of an internal combustion engine according to aspect 4, wherein the engine valve is a first engine valve including one of the suction valve and the exhaust valve, and the holding body is arranged at a position lower than the supporting position on the side of the second engine valve including the other of the suction valve and the exhaust valve in the direction of the rotary centerline so that the holding body overlaps on the second engine valve when viewed in the direction of the rotary centerline.

The invention described in aspect 13 provides the valve train of an internal combustion engine according to aspect 10, wherein the engine valve is a first engine valve including one of the suction valve and the exhaust valve, and the holding body is arranged at a position lower than the supporting position on the side of the second engine valve including the other of the suction valve and the exhaust valve in the direction of the rotary centerline so that the holding body overlaps on the second engine valve when viewed in the direction of the rotary centerline.

BRIEF DESCRIPTION OF THE DRAWINGS

FIG. 1 is a sectional view showing a primary portion of an internal combustion engine having a valve train of the present invention. Concerning the cylinder head, FIG. 1 is a sectional view taken on line $I_a$—$I_a$ in FIG. 2. Concerning the transmitting mechanism of the valve train, FIG. 1 is a sectional view taken on line $I_b$—$I_b$ in FIG. 2.

FIG. 2 is a sectional view taken on line II—II in FIG. 1.

DETAILED DESCRIPTION OF THE PREFERRED EMBODIMENTS

Referring to FIGS. 1 to 10, an embodiment of the present invention will be explained below.

Figure 1:
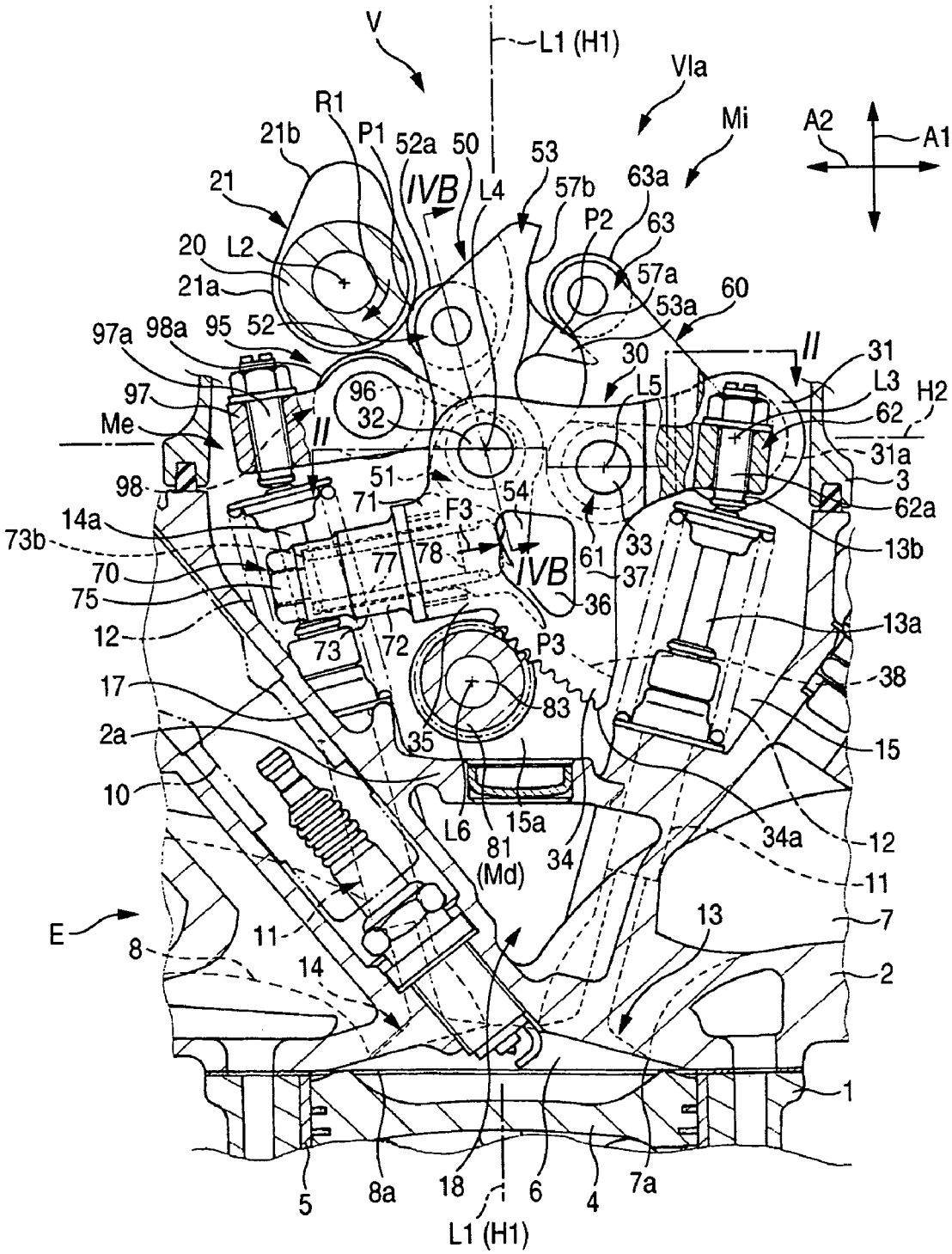
FIG. 1 is a view showing an embodiment of the present invention, that is.

Referring to FIG. 1, the internal combustion engine E having the valve train V of the present invention is an overhead cam shaft type water cooled type straight type 4 cylinder 4 stroke internal combustion engine. This engine is a traverse engine, the crank shaft (not shown) of which is arranged being extended in the width direction of a vehicle. The internal combustion engine E includes: a cylinder block in which 4 cylinders arranged in-line are integrally formed; a cylinder head 2 connected to an upper end portion of the cylinder block, that is, connected to an upper end portion of each cylinder 1; and a head cover 3 connected to an upper end portion of the cylinder head 2. The cylinder block, cylinder head 2 and head cover 3 constitute an engine body of the internal combustion engine E.

In this specification of the present invention, the vertical direction coincides with a direction A1 of a cylinder axis L1 of the cylinder 1. The upward direction is a direction in which the cylinder head 2 is arranged with respect to the cylinder 1 in the axial direction A1 of the cylinder. Further, in this specification of the present invention, the reference plane H1 is a plane which includes the cylinder axis L1 and is parallel with a rotational center line L2 of the inlet cam 21 or the exhaust cam 22 which is a valve train cam. A reference direction A2 is a direction perpendicular to the reference plane H1.

In each cylinder 1, a cylinder hole is formed, with which the piston 4 connected to the crank shaft via a connecting rod (not shown) is reciprocatably engaged. The piston 4 is slidably engaged with the cylinder liner 5 which is formed in the cylinder 1 by casting. In the cylinder head 2, corresponding to each cylinder 1, the combustion chamber 6 is formed on a face opposing to the piston 4 in the cylinder axis direction A1. Further, the inlet port 7 having a pair of suction holes 7*a*, which are open to each combustion chamber 6, is formed, and the exhaust port 8 having a pair of exhaust holes 8*a*, which are open to each combustion chamber 6, is formed. The ignition plug 9 facing each combustion chamber 6 is inserted into the insertion hole 17 which is formed on the exhaust side of the cylinder head 2 together with the ignition coil 10. In this way, the ignition plug 9 is attached to the cylinder head 2.

Concerning the internal combustion engine E, the inlet side is defined as a side on which the entrance of the inlet valve 13 or the inlet port 7 is arranged with respect to the reference plane H1, and the exhaust side is defined as a side on which the exit of the exhaust valve 14 or the exhaust port 8 is arranged with respect to the reference plane H1. The inlet side is one of the sides in the reference plane H1, and the exhaust side is the other of sides in the reference plane H1.

An inlet valve 13 is provided in the cylinder head 2, for each cylinder 1. The inlet valve is reciprocatably supported by the valve guide 11 and is a pair of the first engine valves including poppet valves pushed by the valve springs 12 in the valve closing direction at all times.

An exhaust valve 14 is also provided in the cylinder head 2, for each cylinder 1. The exhaust valve 14 is a pair of the second engine valves including poppet valves pushed by the valve springs 12 in the valve closing direction at all times. The inlet valve 13 and the exhaust valve 14 belonging to each cylinder 1 are opened and closed by the valve train V, so that an inlet port 7*a* and an exhaust port 8*a* can be opened and closed. Except for the electric motor 80 (shown in FIG. 2) for driving the drive shaft 81, the valve train V is accommodated in the valve train chamber 15 formed between the cylinder head 2 and the head cover 3. The valve train V includes a cam shaft 20 pivotally supported by the cylinder head 2. Further, the valve train V includes; a inlet cam 21, which is a first valve train cam, arranged on the cam shaft 20 for each cylinder, rotating together with the cam shaft 20; an exhaust cam 22 (shown in FIG. 2) which is a pair of the second valve train cams; an inlet operation mechanism, which is a first operation mechanism, for opening and closing the inlet valve 13 according to the rotation of the inlet cam 21; and an exhaust operation mechanism, which is a second operation mechanism, for opening and closing the exhaust valve 14 according to the rotation of the exhaust cam 22. In this embodiment, the inlet operation mechanism includes a characteristic changing mechanism capable of controlling the valve operation characteristic, which includes the opening and closing time and the maximum lift of the inlet valve 13, according to a state of operation of the internal combustion engine E.

Figure 2:
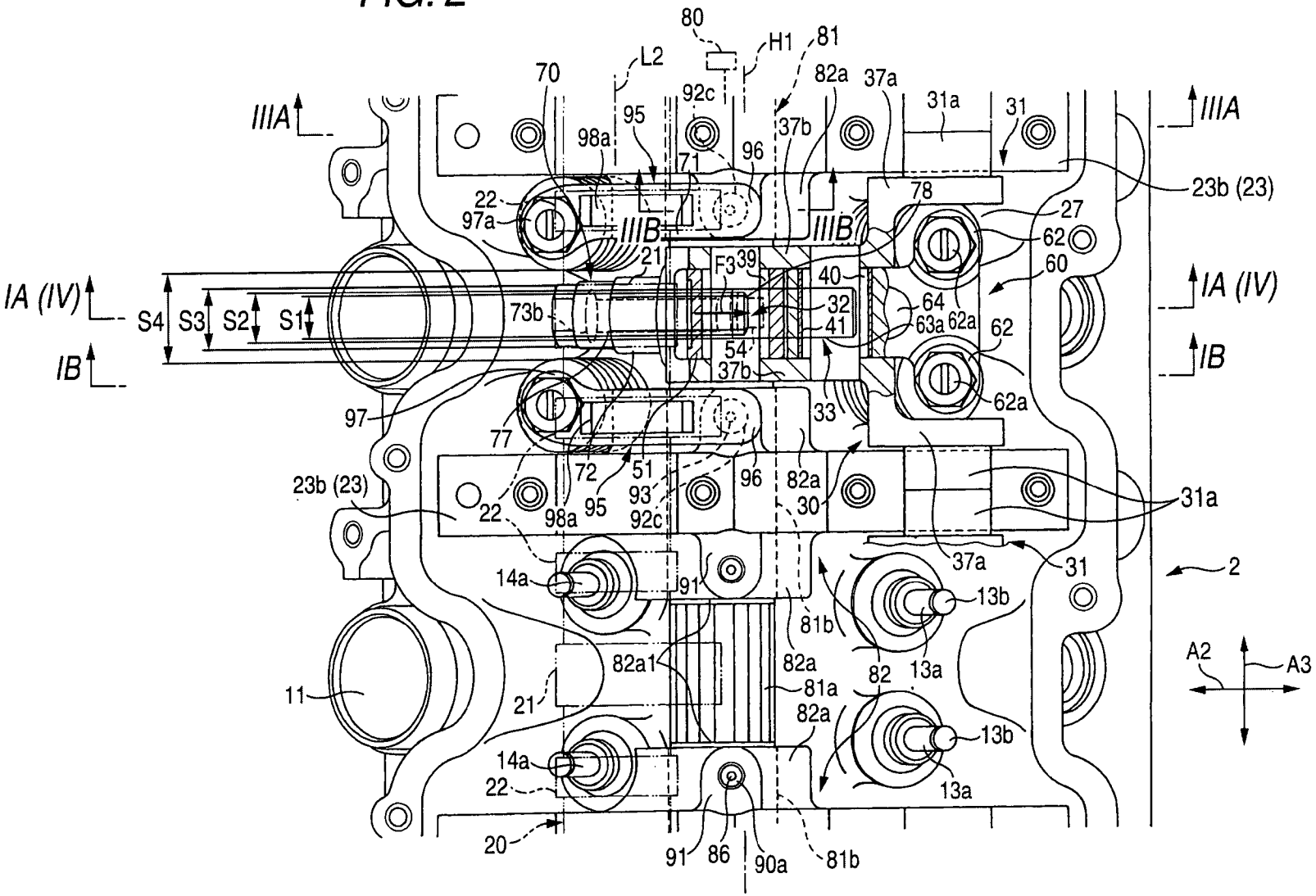
FIG. 2 is a plan view showing a primary portion of the internal combustion engine shown in FIG. 1 in a state in which a head cover is removed. Concerning the valve train.
Figure 3:
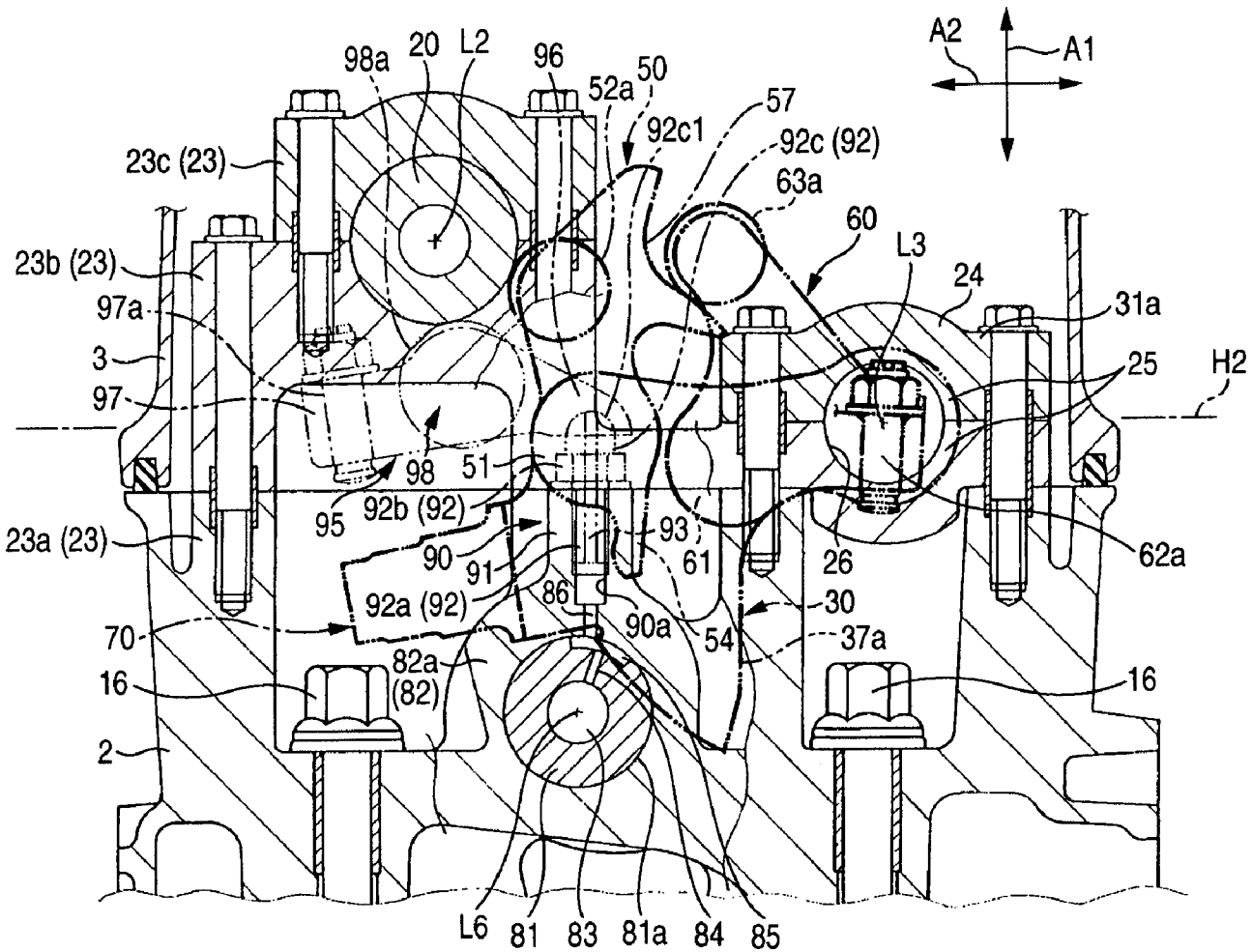
FIG. 3 is a sectional view taken on line $III_a$—$III_a$ in FIG. 2, wherein a portion of FIG. 3 is a sectional view taken on line $III_b$—$III_b$ in FIG. 2.

Referring to FIGS. 1 to 3, the cam shaft 20, which is arranged on the exhaust side in the reference direction A2 and also arranged in an upper portion of the inlet valve 13, the exhaust valve 14 and the exhaust rocker arm 95, is pivotally supported by the cam shaft holder integrally provided in the cylinder head 2 so that rotational center line L2, which is a rotational center axis of the cam shaft 20, can be arranged in parallel with the rotational center axis of the crank shaft. The cam shaft holder includes a plurality of cam bearing sections 23, in this embodiment, the cam shaft holder includes 5 members of cam bearing sections 23 arranged in the cylinder head 2 at the regular interval A3 in the direction of the rotational center line L2. In this case, the direction of the rotational center line L2 is a direction in which the cylinders 1 formed in the cylinder block are arranged. This direction of the rotational center line L2 will be referred to as "an axial direction" hereinafter. Each cam shaft bearing section 23 includes: a base wall 23*a* integrally formed in the cylinder head 2, into which the head bolt 16 for connecting the cylinder head 2 to the cylinder 1 is inserted; a bearing wall 23*b* connected to the base wall 23*a* by a bolt; and a bearing cap 23*c* connected to the bearing wall 23*b*.

The cam shaft 20 is linked with the crank shaft. The cam shaft 20 rotated by a rotating speed which is a half of the rotating speed of the crank shaft by power of the crank shaft. The power of the crank shaft is transmitted through a transmission mechanism used for the valve train having an endless chain which is an endless transmission belt provided between the shaft end portion of the crank shaft and the shaft end portion of the cam shaft 20. Therefore, the cam shaft 20, the inlet cam 21 and the exhaust cam 22 are rotated synchronously with the rotation of the crank shaft, the rotation of the crank shaft is the engine rotation. For each cylinder 1, one inlet cam 21 is arranged between a pair of the exhaust cams 22 in the axial direction A3.

The inlet operation mechanism including the above characteristic changing mechanism includes: a transmission mechanism $M_i$ for transmitting the valve drive force F1 (shown in FIG. 8), which is a valve opening drive force given by the inlet cam 21 so that the inlet valve 13 can be opened and closed, to the inlet valve 13; and a drive mechanism $M_d$ having a electric motor 80, which is an actuator for driving a holder 30 which is a movable body movably supported by the cylinder head 2, provided in the transmission mechanism $M_i$. The valve operation characteristic of the inlet valve 13 is controlled according to the position of the holder 30 moved being driven by the drive mechanism $M_d$.

The transmission mechanism $M_i$ includes: a holder 30 oscillated by the electric motor 80 round the holder centerline L3 which is a centerline parallel with the rotational center line L2; a first rocker arm 50, which is a cam follower, supported by the holder 30 being capable of oscillating round the first centerline L4 moved integrally with the holder 30 and driven by the inlet cam 21; a second rocker arm 60, which is a valve drive member, supported by the holder 30 being capable of oscillating round the second centerline L5 and driven by the first rocker arm 50; and a holding body 70 for holding a spring 77 to generate a bias force which is bias force F3 for pressing the first rocker arm 50 to the inlet cam 21. The transmission mechanism $M_i$ is constituted as one module in which the first rocker arm 50, the second rocker arm 60 and the holding body 70 are integrally incorporated into the holder 30. The substantially entire transmission mechanism $M_i$ is arranged between the inlet valve 13 and the exhaust valve 14 in the reference direction A2.

The second rocker arm 60 is oscillated by the first rocker arm 50 and transmits the valve drive force F1, which is transmitted through the first rocker arm 50, to the inlet valve 13. Therefore, the first and the second rocker arm 50, 60 are oscillation members oscillated round the first and the second centerline L4, L5. Both rocker arms 50, 60 constitute a inlet rocker arm, which is the first cam follower, for opening and closing the inlet valve 13 driven by the inlet cam 21.

The drive mechanism $M_d$ includes: an electric motor 80 (shown in FIG. 2) attached to the engine body at out side of the valve train chamber 15, in this embodiment, the engine body corresponds to the cylinder head 2 and a drive shaft 81 pivotally supported with respect to the cylinder head 2 inside the valve train chamber 15. The drive shaft 81 is rotated by the reversible electric motor 80 and drives and oscillates the holder 30 so that the first supporting position described later can be moved.

In this case, the first and the second centerline L4, L5 and the rotational center line L6, which is an axis of the drive shaft 81, are parallel with the holder centerline L3 located at a position different from the rotational center line L2. The holder centerline L3 is located on the inlet side with respect to the reference plane H1, and the rotational center axis L2, L3 are located on the exhaust side with respect to the reference plane H1. The rotational center line L2 is located at an upper position with respect to the specific plane H2, and the rotational center line L6 is located at a lower position with respect to the specific plane H2. In this case, the specific plane H2 is a plane which includes the holder centerline L3 and is perpendicular to the reference plane H1.

The holder 30 is located between a pair of cam shaft bearing sections 23 which are adjacent to each other in the axial direction A3 for each cylinder 1 and also located at all times in a portion lower than the rotational center line L2 in the oscillating range which is a moving range. This holder 30 includes: a fulcrum section 31 located on the inlet side and supported by the bearing wall 23*b* and the holding cap 24; a first supporting shaft 32, which is a first supporting section, for supporting the first rocker arm 50; a second supporting shaft 33, which is a second supporting section, for supporting the second rocker arm 60; a gear section 34, which is an acting section, located at a position lower than the fulcrum section 31 and the first and the second supporting shafts 32, 33, to which a drive force of the electric motor 80 is given through the drive shaft 81; and an installation section 35 located at a position higher than the gear section 34, in which the holding body 70 is arranged. In this case, the bearing wall 23*b* and the holding cap 24 are members provided on the engine body side. In this case, the members provided on the engine body side are the engine body and the members attached to the engine body.

Figure 8:
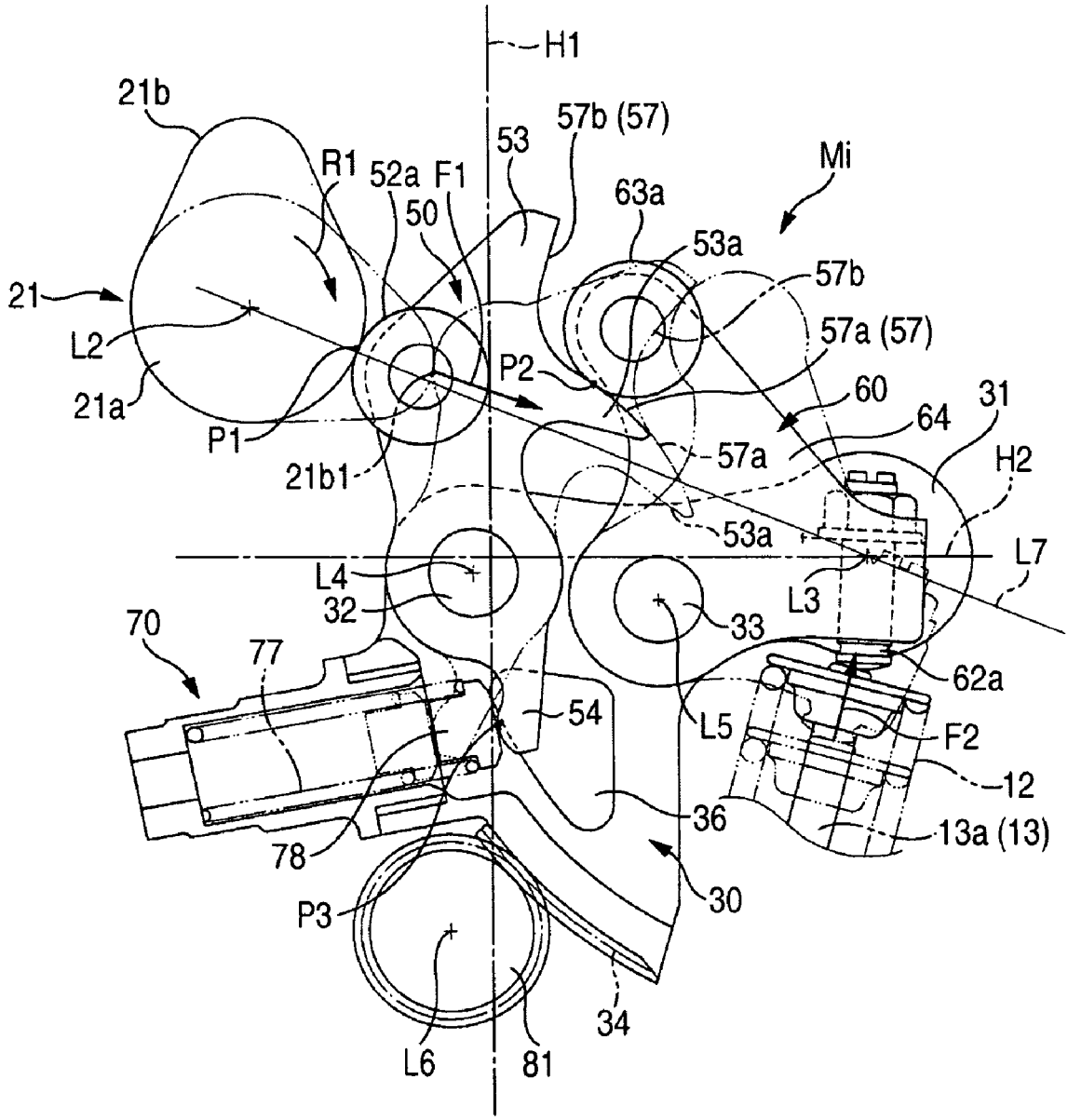
FIG. 8 is a schematic illustration to explain operation of the operation mechanism in the case of obtaining the maximum valve operating characteristic in the valve train shown in FIG. 1.
Figure 9:
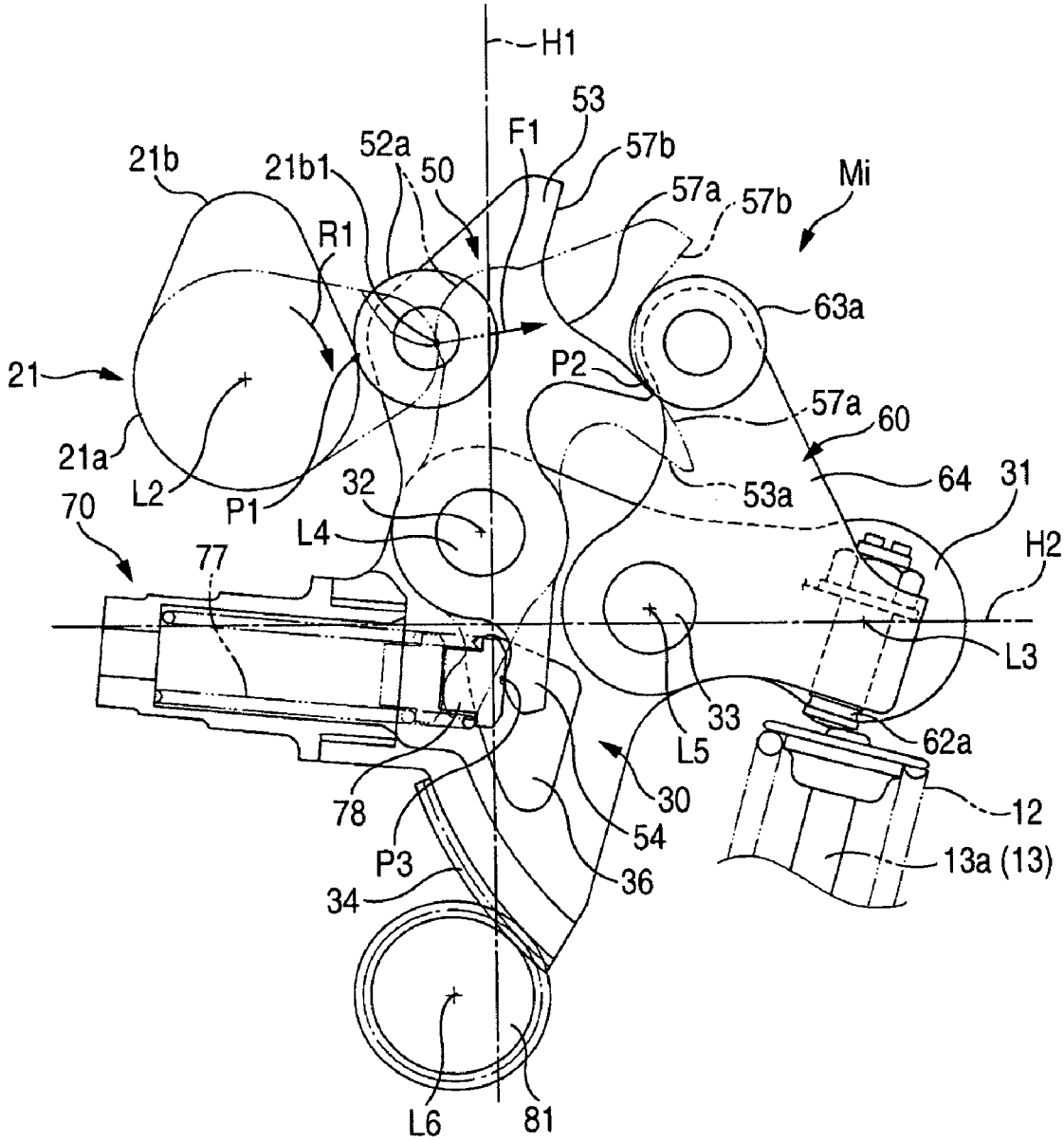
FIG. 9 is a schematic illustration to explain operation of the operation mechanism in the case of obtaining the minimum valve operating characteristic in the valve train shown in FIG. 1.

The first and the second support shafts 32, 33, the gear section 34 and the installation section 35 are arranged between the cam shaft 20 and the fulcrum section 31 in the reference direction A2 and also between the inlet valve 13 and the exhaust valve 14 in the reference direction A2. In the above oscillating range, the gear section 34 is arranged in such a manner that the gear section 34 overlaps with the inlet valve 13 and the exhaust valve 14, which are arranged in the expanding form in which the entire body is expanded in the reference direction A2 when it comes upward, in the axial direction A1 of the cylinder (the vertical direction), and a installation section 35 is arranged in such a manner that at least one portion of the installation section 35 overlaps with the inlet valve 13 and the exhaust valve 14 in the axial direction A1 of the cylinder (the vertical direction) as shown in FIGS. 8 and 9. More specifically, in the above oscillating range, the entire gear section 34 is located in a portion lower than the forward end portion of valve stems 13*a*, 14*a*, and at least one portion of the installation section 35 is located in a portion lower than the forward end portions of the valve stems 13*a*, 14*a*. Further, the first and the second supporting shafts 32, 35 and the installation section 35 are arranged in a triangle, the three sides of which are the rotational center line L2, the holder centerline L3 and the rotational center line L6, when it is viewed from the axial direction A3, which will be referred to as "side view" hereinafter (shown in FIG. 1).

Next, concerning the cam shaft 20, transmission mechanism $M_i$, transmission mechanism $M_e$ and the drive shaft 81, in the valve train chamber 15, the drive shaft 81 is located in a portion lower than the cylinder head 2, more specifically, the drive shaft 81 is located in a portion close to the lowermost portion 15*a* of the valve train chamber 15 (that is, in a portion which is the closest to the cylinder 1). Next, the gear section 34, the installation section 35, the second supporting shaft 33, the first supporting shaft 32, the drive contact section 53 and both contact sections of the following contact section 63 are located in this order from the lower side. The cam shaft 20 is located in an upper portion of the first and the second supporting shafts 32, 33 so that the cam shaft 20 can overlap with the drive contact section 53 and the follow contact section 63 in the vertical direction. The lowermost portion 15*a* is a portion where an interval between the inlet valve 13 and the exhaust valve 14 in the reference direction A2 becomes the minimum in the valve train chamber 15.

Figure 4:
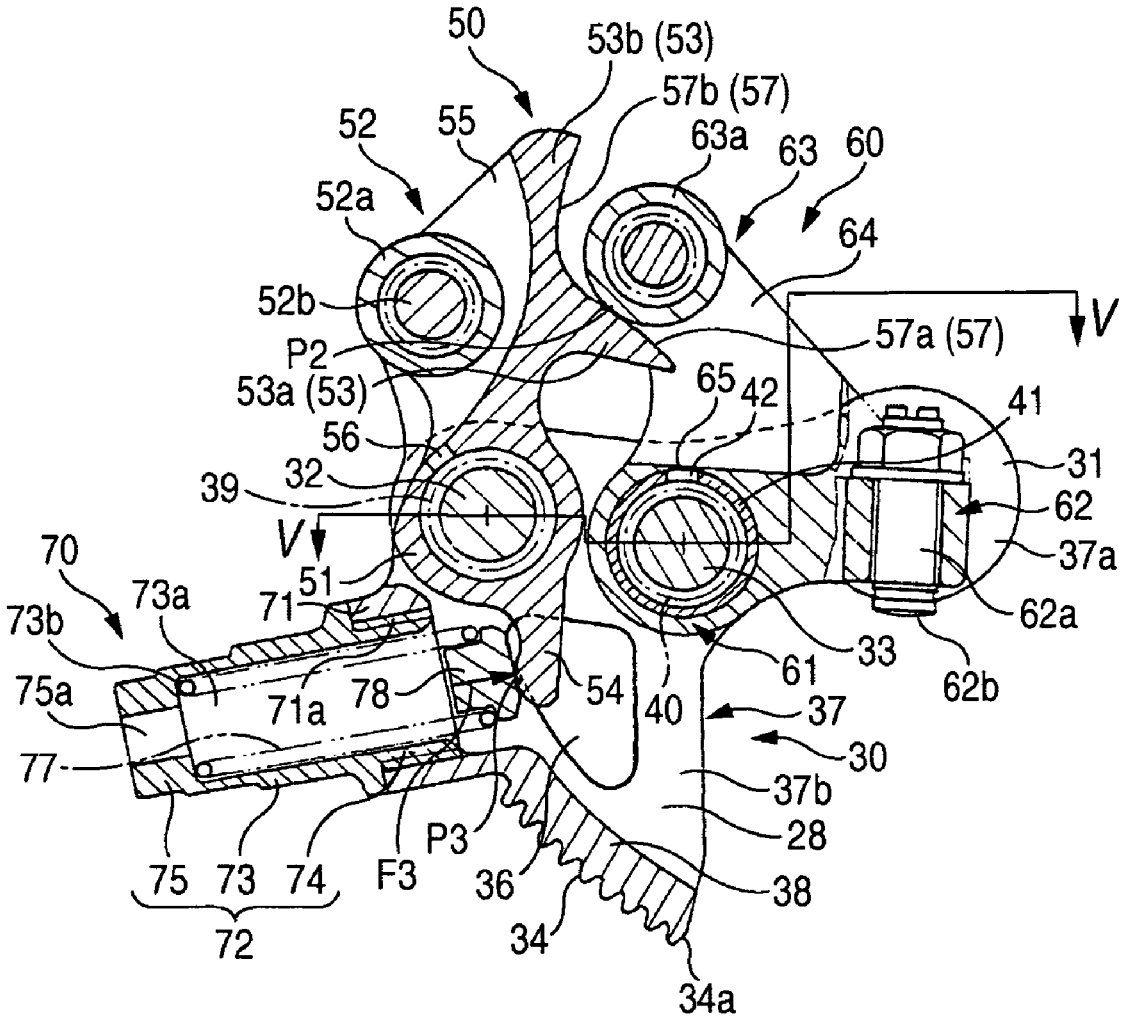
FIG. 4 is a sectional view of the transmitting mechanism of the valve train taken on line IV—IV in FIG. 2.
Figure 5:
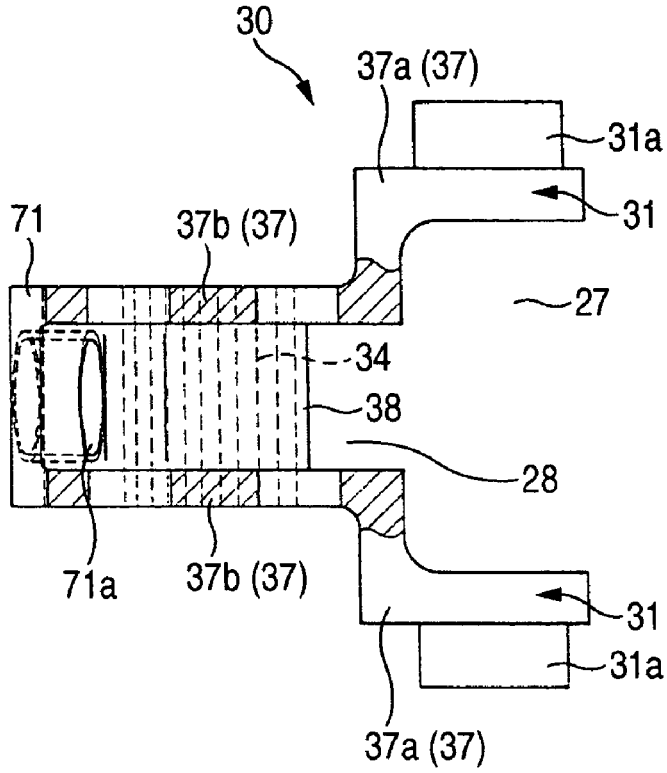
FIG. 5 is a sectional view of the holder of the transmitting mechanism taken on line V—V in FIG. 4.
Figure 6A:
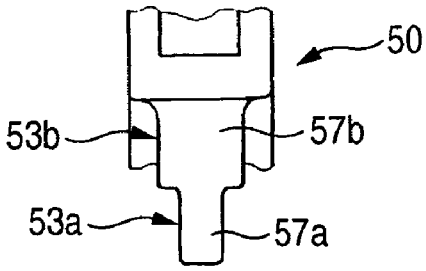
FIG. 6A is an appearance view showing a primary portion of the first rocker arm taken on line $VI_a$ in FIG. 1.
Figure 6B:
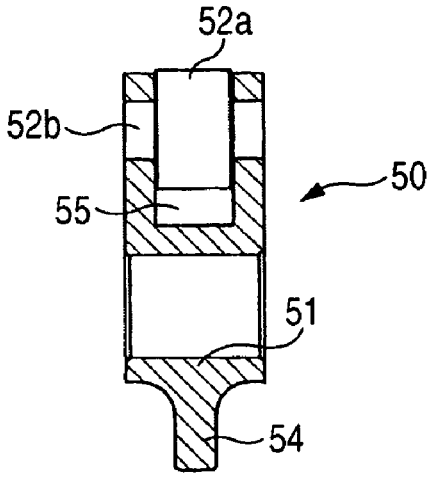
FIG. 6B is a sectional view showing the first rocker arm taken on line $VI_b$—$VI_b$ in FIG. 1.

Referring to FIGS. 4 and 5, in the side view, the holder 30, the shape of which is an approximate sector formed round the holder centerline L3, includes: a pair of side walls 37 opposed to each other in the axial direction A3; and a connecting wall 38 for connecting both side walls 37, wherein the connecting wall 38 constitutes the outermost end portion of the holder 30 in the radial direction round the holder centerline L3, and both side walls 37 and the connecting wall 38 are integrally formed into one body. Each fulcrum section 31 is arranged at a position where the fulcrum section 31 overlaps with the valve contact section 62, which is described later, in the side view. The holder centerline L3 is arranged on an extension of the valve stem 13*a* along the axis of the valve stem 13*a*. Due to the foregoing, a distance between the holder centerline L3 and the line of action of the reaction force F2 (shown in FIG. 8) given from the inlet valve 13 can be maintained short while the maximum distance is limited in the range of the valve stem 13*a*.

Referring to FIGS. 2, 4 and 5, each side wall 37 includes: a first portion 37*a* in which the fulcrum section 31 is constituted when the width of the holder 30 in the axial direction A3 is extended until it comes close to the bearing wall 23*b* while a small gap is formed; and a second portion 37*b*, which is a portion except for the first portion 37*a*, in which the width in the axial direction A3 of the holder 30 is smaller than the first portion 37*a*. In the second portion 37*b*, the first and the second supporting shafts 32, 33, the installation portion 35 and the window 36, which is an opening which opens to the axial direction A3, are provided. On the other hand, the gear section 34 is provided on the connecting wall 38.

As shown in FIGS. 2 and 3, the fulcrum section 31 is supported by a supporting section 25 formed on the bearing wall 23*b*. In cooperation with the holding cap 24 connected to an upper end portion of the bearing wall 23*b* by a bolt, this supporting section 25 forms a hole 26, of cross section is circular, and a columnar supporting shaft 31*a*, which is formed in the fulcrum section 31, is slidably inserted into the hole 26. The supporting shaft 31*a* of the holder 30 belonging to the adjoining cylinder 1 is supported by the common bearing wall 23*b* and the holding cap 24 as shown in FIG. 2. The valve contact section 62 provided in a lower portion of the second rocker arm 60 is arranged in a accommodating space 27 formed by a pair of fulcrum sections 31 in the axial direction A3. A second portion 37*a* is arranged between a pair of exhaust rocker arms 95 and a pair of bearing sections 82 in the axial direction A3.

In the accommodating space 28 (shown in FIG. 5) formed by the second portion 37*b* of a pair of the side walls 37 in the axial direction A3, a fulcrum section 51 and an acting section 54, which are provided in a lower portion of the first rocker arm 50, and the fulcrum section 61, which is provided in a lower portion of the second rocker arm 60, are arranged.

Referring to FIGS. 1, 2 and 4, the first supporting shaft 33 defines the first supporting position, which is a supporting position of the first rocker arm 50 with respect to the cylinder head 2 or the rotational center line L2, and the first centerline L4. The first supporting shaft 33 includes a columnar shaft which is press-fitted into the hole formed on each side wall 37 and fixed. The first rocker arm 50 is oscillatably supported by the first supporting shaft 32 through a bearing 39 including a needle bearing at the fulcrum section 51. The first rocker arm 50 includes: a cam contact section 52 and a drive contact section 53, both of which are provided in a higher portion of the specific plane H2; and an acting section 54 provided in a lower portion of the specific plane H2. The cam contact section 52 includes a roller 52*a* coming into rolling-contact with the inlet cam 21. The cam contact section 52 comes into contact with the inlet cam 21 by the roller 52*a* accommodated in the accommodating space 55 formed by a recess portion of the first rocker arm 50. On the bottom wall constituting the accommodating space 55 which is open toward the upward portion and the inlet cam 21, the oil hole 56 is provided. Lubricant scattering in the valve train chamber 15 reaches to the side wall constituting the accommodating space 55 and the wall face of the bottom wall and flows on the wall faces. Further, lubricant is supplied to the bearing 39 passing in the oil hole 56.

Figure 7A:
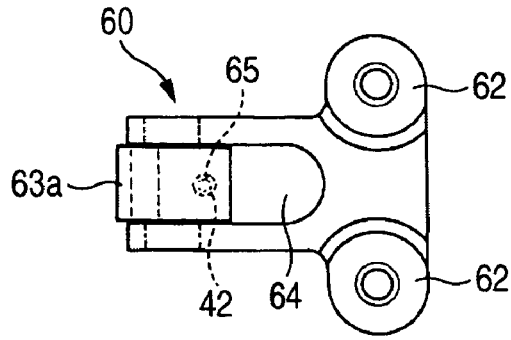
FIG. 7A is a plan view of the second rocker arm shown in FIG. 1.
Figure 7B:
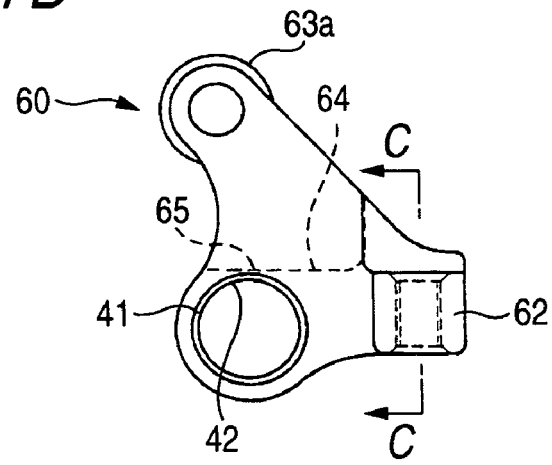
FIG. 7B is a side view of the second rocker arm.
Figure 7C:
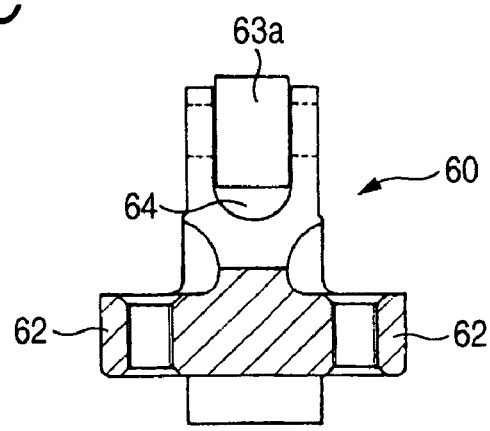
FIG. 7C is a sectional view taken on line C—C in FIG. 7B.

On the other hand, a second supporting shaft 33 defines a second supporting position of the second rocker arm 60 with respect to the cylinder head 2 or the rotational center line L2, and the second center line L5. The second supporting shaft 33 is provided between the first center line L4 and the holder centerline L3 in the reference direction A2. Also, the second supporting shaft 33 includes a cylindrical shaft which is fixed to a hole formed on each side wall 37 being press-fitted. The second rocker arm 60 is oscillatably supported by the second supporting shaft 33 via a bearing 40 constituted by a needle valve. The second rocker arm 60 includes: a follow contact section 63 provided in an upper portion of the specific plane H2, coming into contact with the drive contact section 53; and a pair of valve contact sections 62 respectively coming into contact with the valve stems 13*a* which are contact sections of a pair of inlet valves 13. Referring to FIG. 7, the follow contact section 63 includes a roller 63*a* coming into rolling-contact with the drive contact section 53. The roller 63*a* accommodated in a accommodating space 64 formed by a recess portion of the second rocker arm 60 comes into contact with the drive contact section 53. The cross-sectional shape of the contact face of the follow contact section 63 coming into contact with the cam face 57, which is described later, is an arc. On the outer circumference of the bearing 40, a sleeve 41, which is a reinforcing member to enhance rigidity of the fulcrum portion 61, is provided. On a bottom wall of the accommodating space 64, which opens to the upward portion and the drive contact section 53, the oil hole 65 is provided which opens to the accommodating space 64. In the sleeve 41, the oil hole 42 is provided which is open to the oil hole 65. Lubricant scattering in the valve train chamber 15 attaches to the side wall and the bottom wall constituting the accommodating space 64 and flows on the wall face and passes in both oil holes 65, 42 and is supplied to the bearing 40.

In the entire oscillating range of the holder 30, the first supporting shaft 32 is located at a position crossing the reference plane H1, the first centerline L4 is located at a position close to the reference plane H1, and the second supporting shaft 33 and the second centerline L5 are located on the inlet side. A distance between the holder centerline L3 and respective centerlines of L2, L4, L5 and L6 are increased in the order of the second centerline L5, the first centerline L4, the rotational center line L6 and the rotational center line L2. In the above oscillating range, the first and the second centerline L4 and L5 are moved in a range between the cam shaft side in which the cam shaft 20 is provided (in other words, upper side) and the drive shaft side in which the drive shaft 81 is provided (in other words, lower side).

Relating to the first rocker arm 50, the first supporting shaft 32 and the supporting shaft 52*b* of the roller 52*a*, or the fulcrum section 51 and the cam contact section 52 are arranged so that they can at least partially overlap with each other in the above oscillating range when viewed from the cylinder axis direction A1. This view taken from the cylinder axis direction A1 will be referred to as "a plan view" hereinafter. In the same manner, relating to the second rocker arm 60, the second supporting shaft 33 and the supporting shaft 63*b* of the roller 63*a*, or the fulcrum section 61 and the follow contact section 63 are arranged so that they can at least partially overlap with each other in the above oscillating range in a plan view (shown in FIGS. 8 and 9).

The first and the second rocker arms 50, 60 will be explained in more detail as follows.

Referring to FIGS. 1, 4, 6 and 8, the drive contact section 53 and the follow contact section 63 come into contact with each other. The drive contact section 53, which is one of the contact sections, comes into contact with the roller 63*a* including the follow contact section 63 which is the other contact section. Due to this contact of the drive contact section 53 with the roller 63*a*, the inlet valve 13 can be maintained in a closed valve state in which the inlet valve 13 is closed and also maintained in an open valve state in which the inlet valve 13 is opened. In the drive contact section 53, the cam face 57 is formed on which the idle running face 57*a* for maintaining the inlet valve 13 in a closed state is formed and the drive face 57*b* is also formed on which the drive face 57*b* for maintaining the inlet valve 13 in an open state is formed.

The idle running face 57*a* formed in a first portion 53*a* of the drive contact section 53 is formed in such a manner that a cross-sectional shape of the idle running face 57*a* on the plane perpendicular to the first centerline L4 can be formed into an arc shape of which center is the first centerline L4. Under condition defined that a clearance is formed between the idle running face 57*a* and the roller 63*a* or under a condition defined that the roller 63*a* comes into contact with the idle running face 57*a*, the valve drive force F1 (shown in FIG. 8) of the inlet cam 21, which is transmitted through the first rocker arm 50, is not transmitted to the second rocker arm 60. At this time, the second rocker arm 60 is in the resting state in which the second rocker arm 60 is not oscillated by the inlet cam 21 via the first rocker arm 50. When the first rocker arm 50 and the second rocker arm 60 are contacted with each other under the condition that the roller 52*a* of the first rocker arm 50 comes into contact with the base circle section 21*a* of the inlet cam 21, the roller 63*a* comes into contact with the idle running face 57*a* at all times. Accordingly, when the contact position P2 of the drive contact section 53 with the follow contact section 63 is located at an arbitrary position on the idle running face 57*a*, the inlet valve 13 is maintained in the closed state by a bias force of the valve spring 12. Therefore, valve clearance is formed between the valve contact face 62*b* of the adjusting screw 62*a* described later and the forward end face 13*b* of the valve stem 13*a* which is a contact face of the inlet valve 13.

As described above, when the first and second rocker arms 50, 60 are moved according to the positions of the first and the second centerline L4, L5 which are oscillated integrally with the holder 30 so that the valve operation characteristic can be changed, the relative positions of the first and the second centerline L4, L5 in the holder 30 are not changed and further the cross-sectional shape of the idle running face 57*a* is an arc formed round the first centerline L4. Therefore, it is easy to maintain the clearance formed between the idle running face 57*a* and the roller 63*a*. It is also easy to maintain the contact state with the roller 63*a*. Therefore, even at the time of changing the valve operation characteristic, it is easy to maintain an appropriate valve clearance. Therefore, for example, it is possible to prevent the generation of valve noise caused by an increase in the valve clearance. It is also possible to prevent an increase in the noise caused when both rocker arms 50, 60 collide with each other.

The drive face 57*b* formed in the second portion 53*b* of the drive contact section 53 transmits the valve drive force F1, which is transmitted via the first rocker arm 50, to the second rocker arm 60 so that the second rocker arm 60 can be oscillated. When the adjusting screw 62*a* is contacted with the valve stem 13*a*, the oscillating second rocker arm 60 transmits the valve drive force F1 to the inlet valve 13, so that the inlet valve 13 can be opened by a predetermined lift.

The first portion 53*a* protrudes like a beak toward the follow contact section 63. The width of the first portion 53*a* in the axial direction A3 is smaller than the width of the second portion 57*b* (shown in FIG. 6A). Therefore, the first portion 53*a* can be accommodated in the accommodating space 64 of the second rocker arm 60. Under the condition that the first portion 53*a* is accommodated in the accommodating space 64, the first portion 53*a*, which is a portion of the first rocker arm 50, and the second rocker arm 60 overlap with each other in the side view. As the holder 30 comes close to the first limit position (shown in FIGS. 1 and 8) which is one limit position in the oscillating range and as the first rocker arm 50 oscillates in a direction so that a lift of the inlet valve 13 can be increased, a portion of the first portion 53*a* accommodated in the accommodating space 64 is increased.

In the first rocker arm 50, the acting section 54 is arranged in a portion on the opposite side to the cam contact section 52 and the drive contact section 53 with respect to the fulcrum section 51. A bias force of the spring 77 for biasing the first rocker arm 50 to the inlet cam 21 by the roller 52*a* directly acts on the acting section 54. The width of the acting section 54 in the axial direction A3 in the first rocker arm 50 is smaller than the width of the fulcrum section 51 (shown in FIG. 6B), and the holding body 70 is moved integrally with the holder 30. Therefore, by the substantially minimum length in the range in which the contact state can be maintained in the oscillation of the holder 30 and in which the contact state with the inlet cam 21 can be maintained in the oscillation of the first rocker arm 50, the acting section 54 extends in the radial direction with respect to the first centerline L4 and also extends downward. Further, in the above oscillating range, the acting section 54 comes into contact with the contact member 78 at a position where the acting section 54 overlaps with the first supporting shaft 32 in the plan view, that is, the acting section 54 comes into contact with the contact member 78 right below the first supporting shaft 32. As shown in FIG. 8, the contact position P3 of the acting section 54 with the contact member 78 is closer to the first centerline L4 than the contact position P1 with the inlet cam 21 of the cam contact section 52. In other words, the contact position P3 of the acting section 54 with the contact member 78 is closer to the first supporting position (the first supporting shaft 32) than the contact position P1 with the inlet cam 21 of the cam contact section 52.

Therefore, the first rocker arm 50 is one member including the acting section 54 on which the bias force of the spring 77 directly acts in the inlet rocker arm and also including the cam contact section 52 coming into contact with the inlet cam 21 by the bias force, wherein the first rocker arm 50 is supported at the first supporting position.

Referring to FIGS. 1 and 4, each valve contact section 62 having an adjusting screw 62*a* coming into contact with the valve stem 13*a* is a portion close to the inlet valve 13 in the second rocker arm 60. Each valve contact section 62 is also a portion located on the extension of the valve spring 12 in the expanding and contracting direction (the direction parallel with the valve stem 13*a*).

The shape of the cross section of the valve contact face 62*b* of the adjusting screw 62*a* coming into contact with the forward end face 13*b* of the inlet valve 13 on the plane perpendicular to the second centerline L5 is an arc shape of which center is the holder centerline L3 under the condition that the cam face 57 of the first rocker arm 50 coming into contact with the inlet cam 21 and the roller 63*a* of the second rocker arm 60 are contacted with each other and also under the condition that the second rocker arm 60 is in the resting state, in other words, under the condition that the roller 63*a* comes into contact with the idle running face 57*a*. Therefore, under the condition that the second rocker arm 60 in the resting state comes into contact with the idle running face 57*a*, the valve contact face 62*b* includes a partial columnar face which is a portion of the columnar face, the axis of which is the holder centerline L3. Alternatively, the valve contact face 62*b* includes a partial spherical face formed round one point on the holder centerline L3. When the second rocker arm 60 is in the resting state so that the inlet valve 13 can be maintained in the closed state, the fulcrum section 31 of the holder 30 is located at a position where the fulcrum section 31 overlaps with the valve contact section 62 and the adjusting screw 62*a* in the side view. Under the condition that the second rocker arm 60 in the resting state comes into contact with the idle running face 57*a*, the holder centerline L3 is located at a position where the holder centerline L3 crosses the central axis of the adjusting screw 62*a*.

As described above, no clearance is formed in the transmission route of the valve driving force from the inlet cam 21 to the second rocker arm 60 through the first rocker arm 50. Further, in the resting state in which the second rocker arm 60 is not oscillated by the inlet cam 21 through the first rocker arm 50, the shape of the section of the valve contact face 62*b* of the valve contact section 62 is an arc shape of which center is the holder oscillation centerline L3. Due to the foregoing, even when the holder 30 is oscillated round the holder centerline L3 in order to change the valve operation characteristic, the second rocker arm 60 having the second centerline L5 oscillating together with the holder 30 oscillates together with the holder 30, so that the clearance between the valve contact face 62*a* and the forward end face 13*b* of the inlet valve 13 can be maintained constant. Therefore, the valve clearance from the inlet cam 21 to the inlet valve 13 can be maintained constant.

Next, the holder 30 will be further explained below.

Referring to FIGS. 1 to 5, the holding body 70 is provided integrally with the holder 30 in the installation section 35 so that the holding body 70 can follow the first supporting position (or the first supporting shaft 32) and the acting section 54. The holding body 70 includes: a connecting section 71 for connecting a pair of side walls 37; and a holding section 72 for holding the spring 77. The connecting section 71 connected to the connecting wall 38 is formed integrally with the connecting wall 38 and both side walls 37. The holding section 72, which is a cylindrical member, includes; a cylindrical body 73 in which the spring chamber 73*a* for accommodating the spring 77 is formed; a connecting section 74 having a screw section screwed into the screw hole 71 of the connecting section 71; and an engaging section 75 with which a tool used for screwing the holding section 72 is engaged. The main body 73 and the engaging section 75 of the holding section 72 are arranged between a pair of the exhaust valves 14 in the axial direction A3 so that the main body 73 and the engaging section 75 can overlap with the valve stem 14*a* of each exhaust valve 14 in the side view (shown in FIG. 2). In the engaging section 75, the communicating passage 75*a* is formed which is constituted by a through-hole by which lubricant and air flow into and flow out from the spring chamber 73*a*. Accordingly, the holding body 70 arranged at the first supporting position, that is, the holding body 70 arranged at a lower position of the first supporting shaft 32 and further between the cam shaft 20 and the drive shaft 81 in the vertical direction is moved between the cam shaft 20 and the drive shaft 81 in the vertical direction when the holder 30 is oscillated in the above oscillating range.

The bias member held by the holding body 70 includes: a spring 77 being a compression spring which is an elastic member; and a contact member 78 coming into contact with the acting section 54 so that a transmitting section can be formed which makes a bias force of the spring 77 act on the acting section 54. One end portion of the spring 77 is engaged with the spring receiving section 73*b* (shown in FIG. 4) which is a supporting section provided in the main body 73, and the other end portion of the spring 77 holds the contact member 78. The contact member 78 comes into contact with the acting section 54, so that a bias force of the spring 77 can be directly given to the acting section 54.

As shown in FIGS. 1, 2 and 4, the spring 77 and the contact member 78 are arranged between the holding section 72 of the holding body 70 and the acting section which are opposed to each other in the direction of the line of action of the bias force F3 and also arranged along the plane perpendicular to the rotational center line L2. The bias force F3 is on the plane substantially perpendicular to the rotational center line L2.

As shown in FIG. 2, whole of the holding position of holding the spring 77 in the holding body 70, (the holding position including, position of the spring receiving section 73*b*, the spring 77 and the contact member 78, of the spring 77) is located in range S3 of the arrangement of the inlet cam 21. Or substantially whole of the holding position of the spring 77 is located in range S1, S2 of the arrangement of the roller 52*a*, 63*a* in the axial direction A3. Further, the spring 77 and the contact member 78 have their width in the axial direction A3, which is smaller than width in the axial direction A3 of the fulcrum section 51 of the first rocker arm 50 and the fulcrum section 61 of the second rocker arm 60. The spring 77 and the contact member 78 are entirely arranged in range S4 of the arrangement of the fulcrum sections 51, 61 in the axial direction A3 or in the range of the accommodating space 28 (shown in FIG. 5) in the axial direction A3.

Referring to FIGS. 1 and 4, the window 36 is arranged at a position where the acting section 54 accommodated in the accommodating space 28 (shown in FIG. 5), the contact member 78 and the contact position P3, at which the acting section 54 and the contact member 78 are contacted with each other, overlap with the window 36 in the side view. Lubricant scattering in the valve train chamber 15 passes through the window 36 and is supplied to the acting section 54, the contact member 78 and the contact position P3. Specifically, as shown in FIGS. 8 and 9, when the first rocker arm 50 comes into contact with the base circle section 21*a* of the inlet cam 21, the acting section 54 is located at a position which can be always seen from the window 36 in the entire oscillating range of the holder 30. The contact member 78 and the contact position P3 are located at positions which can be seen from the window 36 in a portion of the oscillating range, for example, at positions which can be seen from the window 36 as the holder 30 comes from the first limit position for defining the above oscillating range to the second limit position (the position shown in FIG. 9).

The gear section 34 is provided on the outer circumferential face in the radial direction formed round the holder centerline L3. The gear section 34 is located at a position in the above oscillating range crossing the reference plane H1. When the holder 30 is located at the first limit position, the most of the gear section 34 is located on the inlet side (shown in FIG. 8). When the holder 30 is located at the second limit position, the most of the gear section 34 is located on the exhaust side (shown in FIG. 9).

Referring to FIGS. 1 to 3, the drive shaft 81 extending in parallel with the cam shaft 20 and the rotational center line L2 is one rotary shaft which is common among all cylinders 1. In the journal section 81*b*, the drive shaft 81 is pivotally supported by the drive shaft bearing section 82, which is integrally formed on the base wall 23*a*, with respect to the cylinder head 2. The drive shaft 81 is located in a lower portion of the cam shaft 20, the holder 30, the first and the second rocker arm 50, 60 and the exhaust rocker arm 95 at a position where the drive shaft 81 overlaps with the lowermost section 34*a* (shown in FIG. 4) of the gear section 34 of the lowermost section of the transmission mechanism $M_i$. This drive shaft 81 is provided with the drive gears 81*a* which are arranged for each cylinder 1 at intervals in the axial direction A3. The drive gear 81*a* is meshed with the gear section 34 provided on the connecting wall 38 and oscillates the holder 30 by the torque generated from the electric motor 80 with respect to the holder centerline L3. Accordingly, the entire drive shaft 81 is located in a lower portion of the entire cam shaft 20 including the inlet cam 21 and the exhaust cam 22.

The drive shaft bearing section 82 has a boss section 82*a* which is a portion swelling upward from the bottom wall 2*a* of the valve train chamber 15 constituted by the upper wall of the cooling water jacket 18 formed in the cylinder head 2. This drive shaft bearing section 82 is arranged at a position different from the position of the cam bearing section 23 in the axial direction A3. Specifically, in each cylinder 1, the boss portion 82 protrudes from a pair of the adjoining cam bearing sections 23 to the opposing direction. In the axial direction A3, the boss portion 82 protrudes toward the holder 30. The outer diameter (the shaft diameter) of the drive shaft 81 is smaller than the outer diameter (the shaft diameter) of the cam shaft 20. Therefore, in order to ensure a smooth movement of the drive shaft 81, it is preferable that the supporting range of the drive shaft bearing section 82 of the drive shaft 81 is larger than that of the cam shaft 20. Therefore, since the drive shaft 81 is supported by the drive shaft bearing section 82 having the boss section 82*a*, the drive shaft 81 can be supported in both the bearing range in the axial direction A3 by the cam bearing section 23 and the bearing range in the axial direction A3 by the boss section 82*a*.

Since the drive shaft 81 is arranged at a position close to the lowermost portion 15*a* corresponding to a portion close to the cylinder 1 in the cylinder head 2, the electric motor 80 is attached to a portion close to the cylinder 1 in the cylinder head 2. The periphery of this lowermost portion 15*a* included in the lower portion of the cylinder head 2 is located close to the connecting section of the cylinder head 2 with the cylinder 1. Therefore, the rigidity of this lowermost portion 15*a* included in the lower portion of the cylinder head 2 is high. The electric motor 80 is controlled by the Electronic control Unit (referred to as "ECU" hereinafter) into which a detection signal is inputted from the operation state detecting means for detecting an operation state of the internal combustion engine E. The operation state detecting means includes: a rotating speed detecting means for detecting an engine rotating speed of the internal combustion engine E; and a load detecting means for detecting a load of the internal combustion engine E from the acceleration pedal operation. When ECU controls a rotating direction and rotating speed of the electric motor 80 according to the above operation state, the rotating direction and the rotation of the drive shaft 81 are controlled, so that the holder can be driven by the electric motor 80 and oscillated in the above oscillating range irrespective of the rotating direction of the inlet cam 21 or the cam shaft 20. Corresponding to the oscillating position of the holder 30 controlled according to the above operation state, the first rocker arm 50 having the first centerline L4 oscillating integrally with the holder 30 and the second rocker arm 60 having the second centerline L5 are respectively moved. Therefore, the opening and closing time of the inlet valve 13, the maximum lift and the maximum lift time, which is the time when the maximum lift can be obtained by one rotation of the inlet cam 21, are variably changed.

Next, the exhaust operation mechanism will be explained below.

Referring to FIGS. 1 to 3, the exhaust operation mechanism includes the transmission mechanism $M_e$ for transmitting a valve drive force of the exhaust cam 22 to each exhaust valve 14 so that each exhaust valve 14 can be opened and closed. The transmission mechanism $M_e$ includes: a pair of the supporting sections 90 arranged for each cylinder on the exhaust side closer to the reference plane H1 than the cam shaft 20; and the exhaust rocker arm 95 which is the third rocker arm used as a pair of the second cam followers supported by a pair of the supporting sections 90 being capable of oscillating.

Each supporting section 90 (shown in FIG. 3) provided in the cylinder head 2 is arranged between the cam bearing sections 23, which are adjacent to each other in the axial direction A3, and between the holder 30 and the cam bearing section 23 in the axial direction A3. Each supporting section 90 include: a base section 91 protruding upward from the upper portion of the boss section 82*a* of the drive shaft bearing section 82, preferably protruding upward from the uppermost portion; and a main body section 92 held by the base section 91. The base section 91 formed integrally with the boss section 82*a* extends to a portion substantially reaching a face on which the base wall 23*a* and the bearing wall 23*b* are put together. The insertion hole 91*a* extending parallel with the direction A1 of the cylinder axis is formed in the base section 91, and the main body section 92 for oscillatably supporting the exhaust rocker arm 95 is inserted into the insertion hole 91*a*. The main body section 92 includes: an accommodating section 92*a* having a screw section screwed to another screw section formed on the wall face of the insertion hole 91*a* and accommodated in the insertion hole 91*a*; an engaging section 92*b* engaging with a tool used when the main body section 92 is screwed; and a shaft supporting section 92*c* which is the uppermost portion of the main body section 92.

The shaft supporting section 92*c* constitutes a spherical bearing together with the fulcrum section 96 of the exhaust rocker arm 95, and spherically supports the fulcrum section 96. Therefore, the shaft supporting section 92*c* has a supporting face 92*c*1 coming into contact with the fulcrum section 96 and supporting the fulcrum section 96, and the supporting face 92*c*1 is constituted by a spherical face or a curved face approximate to the spherical face. Further, one end portion of each main body section 92 is opened to the insertion hole 91*a*, and the second oil passage 93 constituted by a through-hole open to the supporting face 92*c*1 is formed in the other end portion of each main body section 92. On the other hand, in the drive shaft 81, the oil passage 83, into which lubricant is supplied from an oil supply passage not shown, is provided along the rotational center line L6. Further, the oil passage 84 extending in the radial direction is provided, and the oil passage 85 is provided which is consitituted by a groove provided between the journal section 91*b* and the drive shaft bearing section 82 extending in the circumferential direction. An oil passage 86 is provided in the boss section 82*a* so as to communicate the oil passage 85 with the insertion hole 91. Lubricant flows from the oil passage 83 into the insertion hole 91*a* via the oil passages 84, 85 and 86. Further, the lubricant flows from the insertion hole 91*a* onto the supporting face 92*c*1 via the oil passage 93. In this case, the oil passages 83, 84 and 85 constitute the first oil passage provided in the drive shaft 81.

Each exhaust rocker arm 95 is supported by the supporting section 90 at the fulcrum section 96 arrange in one end portion. Further, the exhaust rocker arm 95 comes into contact with the valve stem 14*a* of the exhaust valve 14 at the valve contact section 97 arranged in the other end portion. Furthermore, the exhaust rocker arm 95 comes into contact with the exhaust cam 22 at the cam contact section 98 in a middle portion which is located between the valve contact section 97 and the cam contact section 98. The cam contact section 98 includes a roller 98*a* coming into rolling-contact with the exhaust cam 22, and the roller 98*a* comes into contact with the exhaust cam 22. In this case, in the exhaust valve 14, the valve stem 14*a* is a contact section with which the valve contact section 97 is contacted and the forward end face 14*b* is a contact face of the contact section.

The fulcrum section 96 of the exhaust rocker arm 95 is arranged so that the fulcrum section 96 can overlap with the bearing wall 23*b* and the holder 30 in the side view. Further, the gap between the bearing wall 23*b* and the holder 30 is made as small as possible so that the exhaust rocker arm 95, on the supporting face 92*c*1 of which the fulcrum section 96 is mounted, can be prevented from falling to the axial direction A3 when the exhaust rocker arm 95 is assembled to the cylinder head 2 under the condition that the holder 30 is assembled to the cylinder head 2. In other words, the gap between the bearing wall 23*b* and the holder 30 is made as small as possible in order to prevent the exhaust rocker arm 95 from falling and departing from the supporting face 92*c*1.

The holder 30 is arranged so that the holder 30 can overlap with the drive shaft bearing section 82 and the base portion 91 of the supporting section 90 in the side view. Further, the gap between the drive shaft bearing section 82 and the base section 91 in the axial direction A3 is made as small as possible in order to prevent the holder 30, which is mounted on the supporting section 31, from falling to the axial direction A3 with respect to the specific plane H2 when the holder 30, to which the first and the second rocker arm 50, 60 are assembled, is assembled to the cylinder head 2. Further, the base section 91 having the end face 91*a*, which is located at the same position as the position of the end face 82*a*1 of the boss section 82*a* in the axial direction A3, is provided extending from the boss section 82*a* toward the specific plane H2. Therefore, an inclination of the holder 30 with respect to the specific plane H2 becomes small compared with a case in which the base section 91 is not provided. Accordingly, the effect of preventing the falling can be improved. Since the boss section 82*a* and the base section 91 protrude in the axial direction A3 compared with the rocker arm 95, in the case where the holder 30 is moved in the axial direction A3, the movement in the axial direction A3 can be restricted by the boss section 82*a*, and the occurrence of interference of the holder 30 with the exhaust rocker arm 95 can be prevented.

Next, referring to FIGS. 8 to 10, the valve operating characteristic obtained by the above inlet operating mechanism will be explained as follows.

Figure 10:
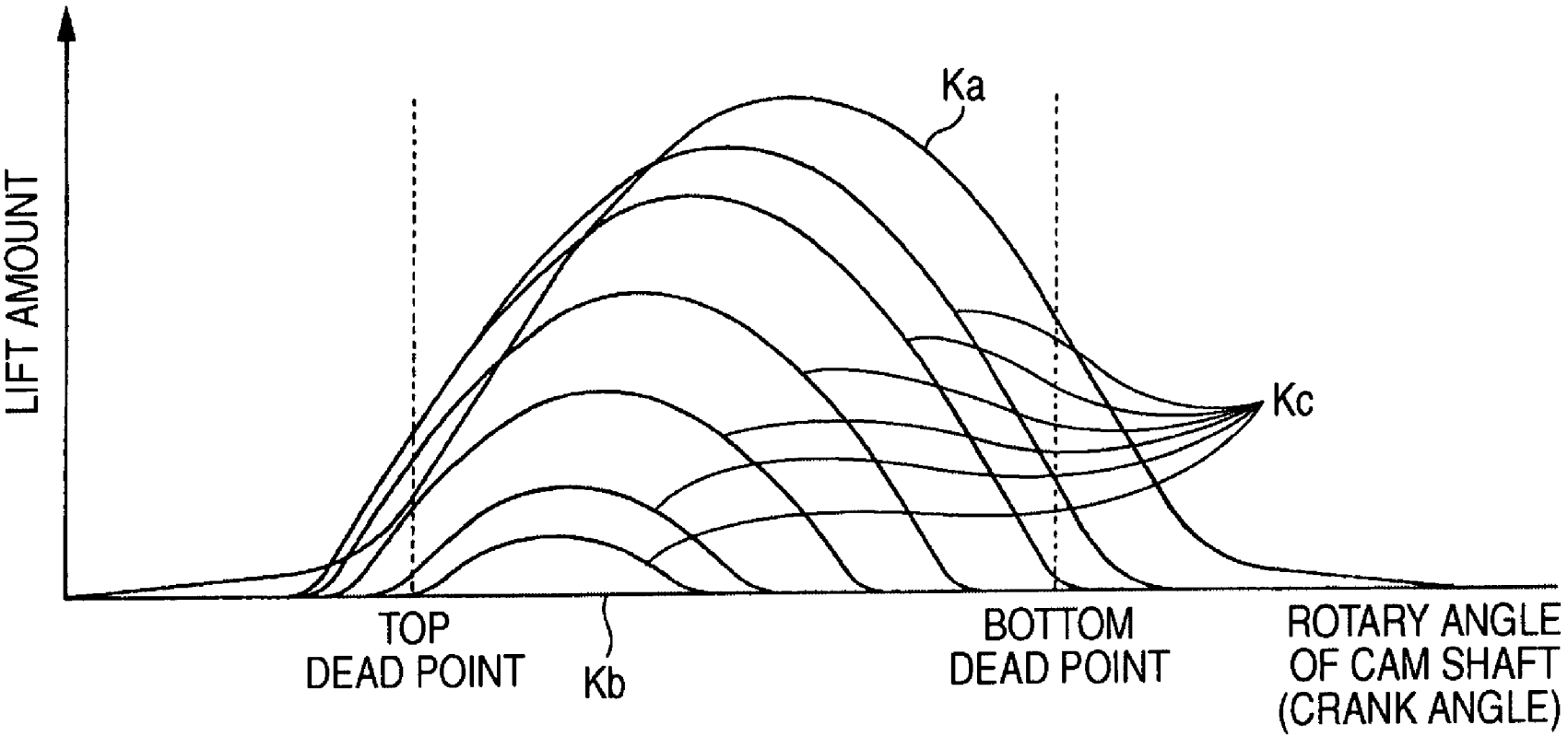
FIG. 10 is a graph showing a valve operation characteristic of the valve train shown in FIG. 1.

Referring to FIG. 10, the valve operating characteristic is variably changed between the maximum valve operating characteristic $K_a$ and the minimum valve operating characteristic $K_b$, wherein the maximum valve operating characteristic $K_a$ and the minimum valve operating characteristic $K_b$ are the limiting characteristics. Between both the valve operating characteristics, numberless intermediate operating characteristics $K_c$ are obtained. For example, changes in the opening and closing time and in the maximum lift of the inlet valve 13 will be described as follows which are from the maximum valve operating characteristic $K_a$, which is the valve operating characteristic when the internal combustion engine E is operated in a high rotating speed region or a heavy load region, to the minimum valve operating characteristic $K_b$ via the intermediate valve operating characteristic $K_c$ which is the valve operating characteristic when the internal combustion engine E is operated in a low rotating speed region or a light load region. The angle of the valve opening time is continuously delayed, and the angle of the valve closing time is continuously advanced by a great change compared with the change in the valve opening time. Therefore, the period of valve opening time is continuously shortened. Further, the angle of the maximum lift time is continuously advanced, and the maximum lift is continuously reduced. In this connection, the maximum lift time equally divides the period of valve opening time into two. In the intermediate valve operating characteristic $K_c$, as compared with the maximum valve operating characteristic $K_a$, the period of valve opening time and the maximum lift are decreased, and the valve opening time is the time when the angle is delayed, and the valve closing time and the maximum lift time are the time when the angle is advanced.

In this embodiment, the minimum valve operating characteristic $K_b$ is a valve operating characteristic in which the maximum lift becomes zero and the valve resting state, in which the opening and closing motion of the inlet valve 13 is rested, can be obtained.

According to the maximum valve operating characteristic $K_a$, in the valve operating characteristic obtained by the above inlet operating mechanism, the period of valve opening time and the maximum lift become the maximum, and the angle of the valve closing time is most delayed. The maximum valve operating characteristic $K_a$ is obtained when the holder 30 is located at the first limiting position shown in FIG. 8 (or FIG. 1). In this connection, in FIGS. 8 and 9, when the inlet valve 13 is in the closed state, the transmitting mechanism $M_i$ is shown by a solid line. When the inlet valve 13 opened by the maximum lift, the transmitting mechanism $M_i$ is shown by a two-dotted chain line.

Referring to FIG. 8, in the above oscillating range, the holder 30, which is at the first limiting position, is located at an oscillating position which is the most distant from the rotational center line L2 or the inlet cam 21 and the closest to the drive shaft 81. Under the condition that the roller 52*a* of the first rocker arm 50 comes into contact with the base circle section 21*a* of the inlet cam 21, the roller 63*a* of the second rocker arm 60 comes into contact with the idle running face 57*a* of the cam face 57. When the first rocker arm 50 is contacted with the cam top portion 21*b* and oscillated by the valve drive force F1 in the rotary direction R (clockwise in FIG. 8) of the inlet cam 21, the drive face 57*b* comes into contact with the roller 63*a*, and the second rocker arm 60 is oscillated in the rotary direction R, so that the second rocker arm 60 opens the inlet valve 13 against the bias force generated by the valve spring 12. Under the condition that the roller 52*a* comes into contact with the top 21*b*1 of the cam top portion 21*b*, the first portion 53*a* of the drive contact section 53 is accommodated in the accommodating space 64 by the maximum ratio.

On the other hand, the minimum valve operating characteristic $K_b$ can be obtained when the holder 30 is located at the second limiting position shown in FIG. 9. In the minimum valve operating characteristic $K_b$, although the first rocker arm 50 is oscillated by the valve drive force F1 of the inlet cam 21, the roller 63*a* is in a state of coming into contact with the idle running face 57*a*, and the second rocker arm 60 is in the above resting state.

As described above, in this valve train V, as the maximum lift is decreased, the angle of the opening time is delayed by a relatively small change. On the other hand, the angles of the valve closing time and the maximum lift are advanced by a relatively large change compared with the change in the valve opening time, and the inlet valve 13 can be quickly closed. Therefore, when the internal combustion engine E is operated in a low rotating speed region or a light load region, the inlet valve 13 is opened and closed in a small lift region, the maximum lift of which is small, and the valve operating characteristic is controlled so that the angle of the closing time of the inlet valve 13 can be advanced, and the inlet valve 13 is quickly closed. Therefore, the pumping loss is decreased and the fuel consumption performance can be enhanced.

Next, referring to FIGS. 8 and 9, operation of the transmitting mechanism $M_t$ will be explained below when the holder 30 is oscillated from the first limiting position to the second limiting position.

When the drive force of the drive shaft 81 driven by the electric motor 80 (shown in FIG. 2) acts on the gear section 34 and the holder 30 is oscillated upward in an oscillating direction (the rotary direction R1) from the first limiting position to the rotational center line L2, the contact position P1 is moved counterclockwise in FIGS. 8 and 9 (in other words, in a direction opposite to the rotating direction R1 of the inlet cam 21). At the same time, the first and the second centerlines L4, L5 are oscillated integrally with the holder 30 so that the contact position P2 can be moved in a direction in which the maximum lift of the inlet valve 12 is reduced and the contact position P2 can be also moved in a direction in which it is separated from the rotational center line L2, and the first and the second rocker arm 50, 60 are oscillated round the first and the second centerline L4, L5.

When the first centerline L4 (or the first supporting shaft 32) is oscillated, the contact position P1 is moved in the opposite rotating direction, and the time at which the roller 52*a* comes into contact with the cam top 21*b* is quickened. On the other hand, under the condition that the roller 52*a* comes into contact with the base circle section 21*a*, the drive contact section 53 is moved in a direction in which a moving range (a range of the rotary angle of the cam shaft 20 or a range of the crank angle of the crank shaft) of the contact position P2 on the idle running face 57*a* can be extended. When the moving range of the contact position P2 on the idle running face 57*a* is extended, even if the first rocker arm 50 contacts with the cam top portion 21*b* and starts oscillating, since the roller 63*a* is located on the idle running face 57*a*, the second rocker arm 60 is in the resting state. When the inlet cam 21 is further rotated, the first rocker arm 50 is further greatly oscillated. When the roller 63*a* comes into contact with the drive face 57*b*, the second rocker arm 60 is oscillated and the inlet valve 13 is opened. Therefore, even under the condition that the roller 62*a* comes into contact with the top 21*b*1 of the cam top portion 21*b*, an oscillation of the second rocker arm 60, which is oscillated by the drive face 57*b*, becomes smaller than that at the first limiting position. Therefore, the maximum lift of the inlet valve 13 is decreased. In this embodiment, when the holder 30 is oscillated from the first limiting position to the second limiting position, as shown in FIG. 10, the angle of the opening time of the inlet valve 13 is delayed by a relatively small change. On the other hand, the shape of the inlet cam 21, the shape of the cam face 57 and the positions of the first and the second centerline L4, L5 are set so that the angles of the valve closing time and the maximum lift time of the inlet valve 13 can be advanced by a change larger than the change in the valve opening time.

Further, when the holder 30 is oscillated from the second limiting position to the first limiting position so that the holder 30 can come close to the rotational center line L2, the angle of the valve opening time of the inlet valve 13 is continuously advanced from the minimum valve operating characteristic $K_b$ to the maximum valve operating characteristic $K_a$, and the angle of the valve closing time is continuously delayed and the period of valve opening time is continuously extended. Further, the angle of the period of maximum lift time is continuously delayed and the maximum lift is continuously increased. In this way, the valve operating characteristic is controlled.

As can be seen from FIG. 8, concerning the cam contact section 52 of the first rocker arm 50, the roller 52*a* is arranged so that the contact position P1 can be located on a specific straight line L7 passing through the holder centerline L3 and the rotational center line L2 on a plane perpendicular to the rotational center line L2 or the holder centerline L3. Specifically, as shown in FIG. 8, when the holder 30 is located at the first limiting position, the contact position P1 in the base circle section 21*a* is located on the specific straight line L7.

When the holder 30 is located at the first limiting position at which the maximum valve operating characteristic $K_a$ is obtained, as compared with the case in which the holder 30 is located at the second limiting position at which the minimum valve operating characteristic $K_b$ is obtained, on a perpendicular plane which is perpendicular to the holder centerline L3, the contact position P1, at which the roller 52*a* of the cam contact section 52 and the cam top portion 21*b* of the inlet cam 21 are contacted with each other, is located at a position close to the specific straight line L7 passing through the holder centerline L3 and the rotational center line L2. Therefore, as the holder 30 comes close to the first limiting position at which the valve drive force F1 is increased, the contact position P1 at which the roller 52*a* and the cam top portion 21*b* are contacted with each other comes close to the specific straight line L7. Therefore, when the contact position P1 comes close to the specific straight line L7, moment acting round the holder centerline L3, which acts on the holder 30 according to the valve drive force F1, comes close to zero. Due to the foregoing, as the holder 30 comes close to the first limiting position at which the valve operating characteristic, in which the maximum lift of the inlet valve 13 can be most increased, can be obtained, the maximum lift is increased. Therefore, the valve drive force F1 is also increased. However, when the contact position PI at the cam top portion 21*b* comes close to the specific straight line L7, the moment acting on the holder 30 can be reduced. Therefore, a drive force of the electric motor 80 to oscillate the holder 30 resisting the moment can be reduced. Accordingly, the electric motor 80 can be made compact.

Next, referring to FIG. 8, the operation of the first and the second rocker arms 50, 60 at the time when the holder 30 is oscillated in the above oscillating range will be explained as follows.

Since the first and the second rocker arms 50, 60 are moved according to the oscillating positions of the first and the second centerline L4, L5 which are oscillating integrally with the holder 30, with remaining the relative positions of the first and the second centerline L4, L5*s* in the holder 30 as that are. Further, since the shape of the cross section of the idle running face 57*a* is an arc formed round the first centerline L4, when the idle running face 57*a* and the roller 63*a* are contacted with each other, irrespective is of the change in the oscillating position of the holder 30, the positional relation among the first and the second centerlines L4, L5 and the contact position P2 is not changed.

Since the first and the second centerlines L4, L5 are oscillated together with the holder 30, it is possible to extend the control range of the valve operating characteristic by increasing a movement of the contact position P1. For example, as compared with a case in which in order to obtain the same contact position as the contact position P2, with respect to the idle running face 57*a*, the first centerline is moved and the second centerline is not moved, a movement of the connect position P1 can be increased in this transmitting mechanism $M_i$. As a result, the valve opening and closing time of the inlet valve 13 can be changed by a change larger than that of the conventional case. Since the control range of the valve operating characteristic is set larger, even when the holder 30 is oscillated by a large oscillation, a relative movement of the contact position P2 with the roller 63*a* can be suppressed small. As a result, the degree of freedom of the arrangement of the transmitting mechanism $M_i$ can be increased, and the applying range can be extended. Further, it is possible to suppress the relative movements of the first and the second rocker arm 50, 60. Accordingly, the control range of the valve operating characteristic of the inlet valve 13 can be set at a wide range.

Next, the operational effect of the above embodiment will be explained below.

The first and the second rocker arm 50, 60 include: an operating section 54 on which a bias force of the spring 77 directly acts; and a contact section 52 coming into contact with the inlet cam 21 by the bias force of the spring 77. The first and the second rocker arm 50, 60 further include the first rocker arm 50 which is one member supported by the first supporting arm 32 for prescribing the first supporting position. Since the holding body 70 moves while following the first supporting position which is moving, when the first supporting position (the first supporting shaft) is moved by the drive mechanism $M_d$, the holding body 70, the spring 77 held by the holding body 70 and the contact member 78 move while following the first supporting position which moves (oscillates) integrally with the holder 30. Therefore, the acting section 54 can be made smaller as compared with a case in which the holding body 70, the spring 77 and the contact member 78 are not moved. Accordingly, the first rocker arm 50 can be made smaller. That is, the valve train V can be made smaller. Further, without increasing the sizes of the spring 77 and the contact member 78, a change in the bias force for giving the bias force to the first rocker arm 50 can be reduced. Accordingly, it is possible to make the spring 77 and the contact member 78 smaller in the size. That is, it is possible to make the valve train V smaller in the size. Further, the bias force can be stabilized, and the operation of the first rocker arm 50 can be stabilized. At this time, the direction of the bias force with respect to the holder 30 is not changed irrespective of the movement of the holder 30.

Further, the spring 77 and the contact member 78 are arranged between the holding body 70 and the acting section 54, which are opposed to each other in the direction of the bias force F3, along the plane perpendicular to the rotational center line L2. Therefore, since the spring 77 and the contact member 78 are compactly arranged in the axial direction A3, the valve train V can be downsized in the axial direction A3.

The entire holding position of the spring 77 in the holding body 70 or the substantially entire holding position of the spring 77 in the holding body 70 is arranged in the ranges S3, S1, S2 in which the inlet cam 21, or the roller 52*a* and the roller 63*a* are arranged in the axial direction A3. Further, the entire holding body 70, the entire spring 77 and the entire contact member 78 are arranged in the range S4 in which the fulcrum section 51 of the first rocker arm 50 and the fulcrum section 61 of the second rocker arm 60 in the axial direction A3 are arranged. Therefore, the spring 77 and the contact member 78 are compactly arranged in the axial direction A3. From this viewpoint, the valve train V can be downsized in the axial direction A3.

Since the bias force is directly given to the acting section 54 of the member of the first rocker arm 50 provided in the cam contact section 52, the bias force can be made to act at a position that is effective for obtaining an appropriate intensity of the bias force with respect to the inlet cam 21. Therefore, an intensity of the bias force can be reduced. Accordingly, it is unnecessary to increase the rigidity of the first rocker arm 50 to which the bias force is given. From this viewpoint, the valve train V can be downsized further.

The cam follower includes the first rocker arm 50 and the second rocker arm 60 which comes into contact with the first rocker arm 50 and is driven by the first rocker arm 50, wherein the second rocker arm 60 has the valve contact section 62. The valve train V supports the first rocker arm 50 at the first supporting position and has the holder 30 for supporting the second rocker arm 60 at the second supporting position (the second supporting shaft 33). Concerning the drive mechanism $M_d$, when the first supporting position of the first rocker arm 50 is moved in order to change the valve operating characteristic of the inlet valve 13 which is opened and closed via the second rocker arm 60 by the first rocker arm 50 when the holder 30 is driven, the second supporting position of the second rocker arm 60 is moved together with the first supporting position of the first rocker arm 50. Therefore, even when the holder 30 is oscillated by a large quantity of oscillation in order to make the control range of the valve operating characteristic larger, a relative movement of the contact position P2 with the roller 63*a* on the cam face 57 can be suppressed small. Therefore, as compared with a case in which the second rocker arm 60 is not moved, it is possible to increase the movement of the first supporting position by a simple structure, and the control range of the valve operating characteristic can be extended.

Since the holding body 70 is provided integrally with the holder 30, the holding body 70 is made to move integrally with the holder 30. Accordingly, the holding body 70 can be made to follow the first supporting position by a simple structure. Accordingly, the structure for making the holding body 70 conduct the following motion can be simplified. Since the contact position P3 of the acting section 54 with the contact member 78 is closer to the first supporting position than the contact position P1 with the inlet cam 21 of the cam contact section 52, when the contact position P1 is moved by the movement of the holder 30, a movement of the acting point of the bias force F3 in the acting section 54 is reduced. Accordingly, a change in the bias force F3 caused by the movement of the first supporting position is suppressed, and the operation stability of the first rocker arm 50 can be enhanced.

The holder 30 includes: a pair of the side walls 37 for forming the accommodating space 28 in which the first and the second rocker arms 50, 60 are accommodated; and the first and the second supporting shafts 32, 33 provided on each side wall 37, for supporting the first and the second rocker arms 50, 60. Since the holding body 70 is provided so as to be able to connect a pair of the side walls 37 at a position different from the first and the second supporting shafts 32, 33, the holder 30 provided with a pair of the side walls 37 is connected by the connecting section 71 of the holding body 70 in a portion except for the first and the second supporting shafts 32, 33. Accordingly, the rigidity of the holder 30 can be enhanced by utilizing the holding body 70. Further, it becomes unnecessary to provide a special reinforcing member to enhance the rigidity of the holder 30, and the holder 30 can be made lighter. Since the first rocker arm 50 is supported by a pair of the side walls 37, it is possible to prevent the first rocker arm 50 from falling by the valve drive force F1, which is given from the inlet cam 21, by the pair of side walls 37. Further, since the supporting rigidity of the first rocker arm 50 is enhanced by the holding body 70, the first rocker arm 50 can be stably operated.

Since the connecting section 71 of the holding body 70 is formed continuously to the connecting wall 38, the connecting section 71 can be constituted by utilizing a portion of the connecting wall 38. Therefore, without providing an exclusive connecting section for arranging the holding body 70 in the holder 30, the space can be effectively put into practical use when the holding body 70 is arranged by utilizing the connecting wall 38.

The holding body 70 is arranged in a lower portion of the first supporting position. Further, the main body 92 is arranged between both the exhaust valves 14 on the side in the axial direction A3 so that the main body 92 can overlap with the exhaust valves 14 in the side view. Due to such the structure, the holding body 70 is arranged by utilizing a space formed between both the exhaust valves 14 on the side of the exhaust valves 14 in the axial direction A3. Accordingly, the valve train V can be downsized in the reference direction A2.

The drive mechanism $M_d$ includes a drive shaft 81, which extends in parallel with the rotational center line L2, for moving the first supporting position. In the valve train chamber 15 formed by the cylinder head 2, the drive shaft 81 is arranged in a lower portion of the first and the second rocker arms 50, 60, and the cam shaft 20 is arranged in an upper portion of the first supporting position. The holding body 70 is arranged between the cam shaft 20 and the drive shaft 81 in the vertical direction. When the holding body 70 is moved between the cam shaft 20 and the drive shaft 81 in the vertical direction, a relatively large space is formed between the cam shaft 20 and the drive shaft 81 in the vertical direction. Therefore, by utilizing the space, the holding body 70 can be moved in the vertical direction. Accordingly, the valve train V can be downsized in the reference direction A2, that is, the cylinder head 2 can be downsized in the reference direction A2. Further, it becomes possible to move the first supporting position by a large movement. Therefore, the control range of the valve operating characteristic can be extended.

Corresponding to the arrangement of the drive shaft 81 which is arranged in a portion close to the lowermost portion 15*a* corresponding to the cylinder 1 in the cylinder head 2, the electric motor 80 is attached to a portion of the cylinder head 2 close to the cylinder 1 in which the rigidity is relatively high in the cylinder head 2. That is, the electric motor 80 is attached to a lower portion of the cylinder head 2. In this way, since the electric motor 80 can be attached to a portion of the cylinder head 2, the rigidity of which is high. Due to the foregoing, it is possible to avoid such a problem that the weight is increased in order to ensure the rigidity so as to attach the electric motor 80, that is, it is unnecessary to provide a special supporting structure for increasing the rigidity. Accordingly, the cylinder head 2 can be made lighter and the structure can be simplified. Further, since the drive shaft 81 is arranged close to the lowermost portion 15*a*, the electric motor 80 is arranged in a portion close to the cooling water jacket 18. Accordingly, heating conducted by the heat transmitted from the engine body is suppressed, and the electric motor 80 is seldom affected by the heat.

The inlet operating mechanism has the drive mechanism $M_d$ including: the first rocker arm 50 for opening and closing the inlet valve 13 being driven by the inlet cam 21; and the drive shaft 81 for moving the first supporting position of the first rocker arm 50. The valve operating characteristic of the inlet valve 13 is changed when the first supporting position is moved. The exhaust operating mechanism includes the exhaust rocker arm 95 for opening and closing the exhaust valve 14 being driven by the exhaust cam 22. Since the drive shaft 81 is arranged in a lower portion of the cam shaft 20 between the inlet valve 13 and the exhaust valve 14 in the reference direction A2, the inlet cam 21 and the exhaust cam 22 are provided. Therefore, in a lower portion of the cam shaft 20 which requires a larger space in the radial direction than the space in the radial direction occupied by the drive shaft 81 in order to change in the valve operating characteristic, further between the inlet valve 13 and the exhaust valve 14 in the reference direction A2, the drive shaft 81 is arranged. Therefore, the valve train V can be downsized in the reference direction A2. Accordingly, the cylinder head 2 in which the valve train V is provided can be downsized in the reference direction A2.

Structures will be enumerated below in which the valve train V is downsized in the reference direction A2 by compactly arranging the first and the second rocker arms 50, 60 in the reference direction A2.

The first supporting shaft 32 of the first rocker arm 50 and the supporting shaft 52*b* of the roller 52*a*, or the fulcrum section 51 and the cam contact section 52 are arranged so that they can at least partially overlap with each other in the plan view. In the same manner, the second supporting shaft 33 of the second rocker arm 60 and the supporting shaft 63*b* of the roller 63*a*, or the fulcrum section 61 and the idle follow contact section 63 are arranged so that they can at least partially overlap with each other in the above oscillating range in the plan view.

Under the condition that the first portion 53*a* of the first rocker arm 50 is accommodated in the accommodating space 64 of the second rocker arm 60, the first portion 53*a* and the second rocker arm 60 are arranged so that they can overlap with each other in the side view.

The drive shaft 81 arranged in a lower portion of the exhaust rocker arm 95 is pivotally supported by the drive shaft bearing section 82 provided at a position different from the cam bearing section 23 in the axial direction A3. Since the supporting section 90 having the supporting face 92*c*1 for supporting the exhaust rocker arm 95 is provided in an upper portion of the boss section 82*a* of the drive shaft bearing section 82, the supporting section 90 is provided by utilizing the drive shaft bearing section 82 for supporting the drive shaft 81. Accordingly, the supporting section 90 can be downsized as compared with a case in which the boss section 82*a* is not provided. By utilizing the space formed in the upper portion of the drive shaft bearing section 82, the supporting section 90 is arranged. Therefore, the supporting section 90 can be compactly arranged in the axial direction A3. Accordingly, the valve train V can be downsize in the axial direction A3.

Since the drive shaft bearing section 82 is formed integrally with the cam bearing section 23, it is possible to enhance the rigidity of the base wall 23*a* of the cam shaft bearing section 23 without providing a special reinforcing member.

The exhaust rocker arm 95 is spherically supported by the support face 92*c*1 and arranged between the cam bearing section 23 and the holder 30 in the axial direction A3 so that the exhaust rocker arm 95 can be prevented from falling to the axial direction A3 by the contact of the transmitting mechanism $M_i$, which constitutes the cam bearing section 23 and the inlet operating mechanism, with the holder 30 and so that the exhaust rocker arm 95 can overlap with the cam bearing section 23 and the holder 30 in the side view. Due to the above structure, when the spherically supported exhaust rocker arm 95 is arranged in the supporting section 90, even if the exhaust rocker arm 95 supported by the supporting section 90 is going to fall to the axial direction A3, the exhaust rocker arm 95 comes into contact with the cam bearing section 23 and the holder 30 located on both sides of the second cam follower in the axial direction A3. Therefore, the exhaust rocker arm 95 can be prevented from falling, and the assembling property of the exhaust rocker arm 95 with respect to the cylinder head 2 can be enhanced.

The transmitting mechanism $M_i$, which is a module of the inlet operating mechanism, is arranged between a pair of the bearing sections 82 so that the transmitting mechanism $M_i$ can be prevented from falling to the axial direction A3 by the contact with a pair of bearing sections 82 adjoining in the axial direction A3 and so that the transmitting mechanism $M_i$ can overlap with both the bearings 82 in the side view. Due to the above structure, when the transmitting mechanism $M_i$ is arranged between a pair of the bearing sections 82, even it the transmitting mechanism $M_i$ is going to fall to the side, since the transmitting mechanism $M_i$ comes into contact with the bearing sections 82 located on both sides, the transmitting mechanism $M_i$ can be prevented from falling. Accordingly, the assembling property of the transmitting mechanism $M_i$ with respect to the cylinder head 2 can be enhanced.

The oil passages 83 to 85 are provided in the drive shaft 81, the oil passage 86 is provided in the drive shaft bearing section 82, and the oil passage for guiding the lubricant, which is sent from the oil passages 83 to 86, to the supporting face 92*c*1 is provided in the supporting section 90. Since the oil passages 83, 84, 85 to guide the lubricant to the supporting face 92*c*1 can be formed by utilizing the drive shaft 81 and the drive shaft bearing section 82, it becomes easy to form the oil passage supplied to the supporting face 92*c*1. Since the rotation of the drive shaft 81 seldom fluctuates compared with the cam shaft 20, the fluctuation of hydraulic pressure in the oil passages 83, 84, 85 is so small that the lubricant of stable hydraulic pressure can be supplied to the supporting face 92*c*1. Accordingly, the lubricating property on the supporting face 92*c*1 can be enhanced.

The drive shaft 81 is arranged in a lower portion, the rigidity of which is high, of the cylinder head 2 close to the connecting section with the cylinder 1. Preferably, the drive shaft 81 is arranged close to the lowermost section 15*a* of the valve train chamber 15. Therefore, the drive shaft 81 is highly rigidly supported. Accordingly, the drive shaft 81 driven by the electric motor 80 operates highly accurately and oscillates the holder 30. As a result, the control accuracy of the valve operating characteristic of the inlet valve 13 can be enhanced.

When the drive shaft, the shaft diameter of which is smaller than that of the cam shaft 20, is arranged in a portion close to the lowermost portion 15*a* in which an interval of the inlet valve 13 and the exhaust valve 14 in the reference direction A2 is the smallest in the valve train chamber 15. Due to the foregoing, the space formed between the inlet valve and the exhaust valve 14 can be effectively put into practical use.

Since the rotational center axis L2, L6 of the cam shaft 20 and the drive shaft 81 are arranged on the exhaust side, the accommodating space for accommodating the transmission mechanism $M_i$ can be ensured on the inlet side, and the exhaust rocker arm 95 can be downsized. The rotational center line L6 of the drive shaft 81 is arranged on the exhaust side with respect to the holder centerline L3 arranged on the inlet side. The gear section 34, to which a drive force of the drive shaft 81 is given, is formed on the outer circumferential face in the radial direction formed round the holder centerline L3 on the connecting wall 38 constituting the outermost end section of the holder 30 in the radial direction formed round the holder centerline L3. Due to the foregoing, an intensity of the drive torque of the electric motor 80 to move the holder 30 can be reduced.

An embodiment in which a portion of the above embodiment is changed will be explained below.

The holder 30 may be directly oscillatably supported by the cylinder head 2. The holder centerline L3 may coincide with the rotational center line L2. The holder 30 is not necessarily constituted by a member which is special for each cylinder. Different members may be connected into one body by a connecting means. Alternatively, the holder 30 may be constituted being integrated into one body for all cylinders 1.

The spring 77 itself constituting the above bias member or the elastic member itself may be contacted with the acting section 54 without using the contact member 78. As long as the holding body 70 itself can hold the spring 77, an arbitrary member except for a cylindrical member may be used, and the structure in which the spring chamber 73*a* is not formed may be adopted. The connecting section 71 of the holding body 70 may be provided separately from the holder 30 and attached to both the side walls 37.

The cam contact section 52 may not be a roller but a member such as a slipper or a portion having a sliding face. The idle follow contact section 62 may not be a roller but a member such as a slipper or a portion having a sliding face, the shape of the cross section of which is an arc.

The exhaust rocker arm may be oscillatably supported by the rocker shaft. The supporting section 90 may be formed integrally with the boss section 82*a*. The drive shaft bearing section 82 may be provided separately from the cam bearing section 23. In the above embodiment, the drive shaft 81 is directly supported by the cylinder head 2 via the drive shaft bearing section 82 integrally formed on the cylinder head 2. However, when the bearing section of the drive shaft 81 is constituted by a member different from the cylinder head 2 and the bearing section is connected to the cylinder head 2, the drive shaft 81 may be indirectly supported by the cylinder head 2 via the bearing section. The bearing wall 23*b* constituting the cam bearing section 23 may be integrally formed in the cylinder head 2 together with the base wall 23*a*.

When at least a portion of the holding position of the spring 77 in the holding body 70 is located in the ranges S3, S1, S2 in which the inlet cam 21, or the roller 52*a* and the roller 63*a* are arranged in the axial direction A3, although the effect of making the valve train compact is lowered, the valve train V can be made smaller in the axial direction A3.

The first and the second supporting shaft may be constituted by a shaft, at both end portions of which the screw portions are provided, and fixed to the holder by a nut screwed to the screw portion.

Following structure may be adopted. Instead of the holder 30, a guide member may be provided which has guide grooves for respectively guiding the first and the second supporting shaft and the holding body 70. When a movable body driven by the drive mechanism $M_d$ moves the first and the second supporting shaft and the holding body 70 along the above guide grooves, the first and the second centerlines of the first and the second rocker arms 50, 60 are moved, and the holding body 70 is moved while following the first supporting position of the first rocker arm 50 and the acting section 54 so that a change in the bias force F3 of the spring 77 can be reduced as compare with a case in which one end portion of the spring 77 is fixed.

Instead of the above inlet operating mechanism, the exhaust operating mechanism may be constituted by the above characteristic changing mechanism. The above inlet operating mechanism and the exhaust operating mechanism may be constituted by the above characteristic changing mechanism. The valve train V may be provided with a pair of cam shafts including an inlet cam shaft, in which an inlet cam is provided, and an exhaust cam shaft in which an exhaust cam is provided. At least, one of the engine valves including the inlet valve and the exhaust valve may be constituted by one engine valve for one cylinder 1.

The drive mechanism $M_d$ may be provided with a member oscillated by the drive shaft or a link mechanism as a means for giving a drive force to the acting section 54 instead of the drive gear 29*b*. Concerning the drive mechanism $M_d$, a common drive shaft may not be provided for all cylinders 1. A specific cylinder 1 may be provided with a drive shaft driven by another actuator.

In the minimum valve operating characteristic $K_b$, the maximum lift value becomes zero. However, the minimum valve operating characteristic may be a characteristic in which the maximum lift value s a value other than zero.

The internal combustion engine for vehicle use is explained in the above embodiment. However, the internal combustion engine may be an engine used for a ship propulsion unit such as an outboard engine, the crank shaft of which is perpendicularly arranged. The internal combustion engine may be a multiple cylinder internal combustion engine except for a 4-cylinder engine. Alternatively, the internal combustion engine may be a single cylinder engine.

According to the invention described in aspect 1, the following advantages can be provided. Even when the control range of the valve operation characteristic of the engine valve is set large by increasing a movement of the supporting position, the acting section can be reduced. Therefore, the cam follower can be downsized, that is, the valve train can be downsized. Further, since a change in the bias force is reduced without making the bias member larger, the bias member can be downsized, that is, the valve train can be downsized. At the same time, the bias force can be stabilized and the cam follower can be stably operated. Further, since the bias member is compactly arranged in the direction of the rotary centerline, the valve train can be made smaller in the direction of the rotary centerline. Furthermore, since it is unnecessary to increase the rigidity of the cam follower to which a bias force is given, the valve train can be downsized in this viewpoint.

According to the invention described in aspect 2, in addition to the advantages of the invention described in the cited aspect, the following advantages can be provided. Since the first supporting position for supporting the cam follower by the holder and the second supporting position for supporting the valve drive member can be moved, it is possible to increase a movement of the first supporting position by a simple structure. Therefore, the control range of the valve operation characteristic can be extended.

According to the invention described in aspect 3, in addition to the advantages of the invention described in the cited aspect, the following advantages can be provided. The holding body can follow a movement of the first supporting position by a simple structure. Further, a change in the bias force caused when the first supporting position is moved can be suppressed. Therefore, the cam follower can be more stably operated.

According to the invention described in aspect 4, in addition to the advantages of the invention described in the cited aspect, the following advantages can be provided. The rigidity of the holder can be enhanced by utilizing the holding body. Further, it is unnecessary to provide a special reinforcing member for enhancing the rigidity of the holder. Accordingly, it becomes possible to make the holder lighter. Furthermore, the cam follower can be prevented from falling by each side wall and supported by high supporting rigidity. Therefore, the cam follower can be stably operated.

According to the invention described in aspect 5, in addition to the advantages of the invention described in the cited aspect, the following advantages can be provided. Since the holding body is arranged in a space on the side of the second engine valve in the direction of the rotary centerline, the valve train can be downsized in the reference direction.

According to the invention described in aspect 6, in addition to the advantages of the invention described in the cited aspect, the following advantages can be provided. The holding body can be moved in the vertical direction by utilizing a space formed between the cam shaft and the drive shaft. Therefore, the valve train can be downsized in the reference direction. Further, the supporting position can be moved by a large movement. Accordingly, the control range of the valve operation characteristic can be extended. Since the drive shaft is supported by high supporting rigidity, the drive shaft can be highly accurately operated, and the control accuracy of the valve operating characteristic can be enhanced.

According to the invention described in aspect 7, the same advantage as that of the invention described in aspect 1 can be provided.

Further, according to the inventions of the aspects 8 to 13, the similar effect is expected.

Besides, although the holding body 70 is integrally provided in the holder 30 in the above embodiments, the holding body 70 is not necessarily provided in the holder 30, and the holding body 70 and the holder 30 may relatively move with respect to each other.

Further, in one of the embodiments of the present invention, there is provided the cam follower having two rocker arms. It is adaptable to make the cam follower having one rocker arm for reducing the size of the valve train.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

What is claimed is:

1. A valve train of an internal combustion engine provided in the internal combustion engine including a cylinder having a cylinder axis and a cylinder head connected to an upper end portion of the cylinder, the valve train of the internal combustion engine comprising:

a cam follower driven by a valve train cam provided on a cam shaft, for opening and closing an engine valve;

a holding body for holding a bias member to generate a bias force for biasing the cam follower to the valve train cam; and a drive mechanism for moving a supporting position of the cam follower, wherein a valve operation characteristic of the engine valve is changed when the supporting position is moved, the cam follower includes: an acting section on which the bias force directly acts; and a cam contact section coming into contact with the valve train cam by the bias force, and is supported at the supporting position, the holding body moves while following the supporting position that is moving, and the bias member is arranged between the holding body and the acting section, which are opposed to each other in a direction of a line of action of the bias force, along a plane perpendicular to a rotary centerline of the cam shaft.

2. The valve train of an internal combustion engine according to claim 1, wherein the cam follower opens and closes the engine valve via a valve drive member having a valve contact section which comes into contact with the engine valve, the valve train has a holder for supporting the cam follower at a first supporting position which is the supporting position, and for supporting the valve drive member at a second supporting position, and the drive mechanism drives the holder.

3. The valve train of an internal combustion engine according to claim 2, wherein the holding body is integrally provided in the holder, and a contact position of the acting section with the bias member is closer to the first supporting position than the contact position of the cam contact section with the valve train cam.

4. The valve train of an internal combustion engine according to claim 2, wherein the holder includes:

a pair of side walls for forming an accommodation space in which the cam follower is accommodated; and a supporting section provided on each side wall, for supporting the cam follower, and the holding body connects the pair of side walls at a position different from the position of the supporting body.

5. The valve train of an internal combustion engine according to claim 3, wherein the engine valve is a first engine valve including one of the suction valve and the exhaust valve, and the holding body is arranged at a position lower than the first supporting position on the side of the second engine valve including the other of the suction valve and the exhaust valve in the direction of the rotary centerline so that the holding body overlaps on the second engine valve when viewed in the direction of the rotary centerline.

6. The valve train of an internal combustion engine according to claim 1, wherein the drive mechanism extends in parallel with the rotary centerline and includes a drive shaft for moving the supporting position, the drive shaft is arranged at a position lower than the cam follower in a valve train chamber formed by the cylinder head, the cam shaft is arranged at a position higher than the supporting position, and the holding body is arranged between the cam shaft and the drive shaft in the vertical direction and moved between the cam shaft and the drive shaft in the vertical direction.

7. The valve train of an internal combustion engine according to claim 1, wherein the cam follower opens and closes the engine valve via a valve drive member having a valve contact section which comes into contact with the engine valve, the valve train has a holder for supporting the cam follower at a supporting position which is the supporting position.

8. The valve train of an internal combustion engine according to claim 7, wherein the holding body is integrally provided in the holder, and a contact position of the acting section with the bias member is closer to the supporting position than the contact position of the cam contact section with the valve train cam.

9. The valve train of an internal combustion engine according to claim 7, wherein the holder includes:

a pair of side walls for forming an accommodation space in which the cam follower is accommodated; and a supporting section provided on each side wall, for supporting the cam follower, and the holding body connects the pair of side walls at a position different from the position of the supporting body.

10. The valve train of an internal combustion engine according to claim 8, wherein the engine valve is a first engine valve including one of the suction valve and the exhaust valve, and the holding body is arranged at a position lower than the supporting position on the side of the second engine valve including the other of the suction valve and the exhaust valve in the direction of the rotary centerline so that the holding body overlaps on the second engine valve when viewed in the direction of the rotary centerline.

11. The valve train of an internal combustion engine according to claim 4, wherein the engine valve is a first engine valve including one of the suction valve and the exhaust valve, and the holding body is arranged at a position lower than the supporting position on the side of the second engine valve including the other of the suction valve and the exhaust valve in the direction of the rotary centerline so that the holding body overlaps on the second engine valve when viewed in the direction of the rotary centerline.

12. The valve train of an internal combustion engine according to claim 9, wherein the engine valve is a first engine valve including one of the suction valve and the exhaust valve, and the holding body is arranged at a position lower than the supporting position on the side of the second engine valve including the other of the suction valve and the exhaust valve in the direction of the rotary centerline so that the holding body overlaps on the second engine valve when viewed in the direction of the rotary centerline.

13. A valve train of an internal combustion engine provided in the internal combustion engine including a cylinder having a cylinder axis and a cylinder head connected to an upper end portion of the cylinder, the valve train of the internal combustion engine comprising:

a cam follower driven by a valve train cam provided on a cam shaft, for opening and closing an engine valve;

a holding body for holding a bias member to generate a bias force for biasing the cam follower to the valve train cam; and a drive mechanism for moving a supporting position of the cam follower, wherein a valve operation characteristic of the engine valve is changed when the supporting position is moved, the cam follower includes: an acting section on which the bias force directly acts; and a cam contact section coming into contact with the valve train cam by the bias force, and is supported at the supporting position, the holding body moves while following the supporting position that is moving, and at least one portion of the holding position of the bias member in the holding body is in a range of the arrangement of the valve train cam or the cam contact section in a direction of the rotary centerline of the cam shaft.

* * * * *